US005867391A

United States Patent [19]

Muto

[11] Patent Number: 5,867,391

[45] Date of Patent: Feb. 2, 1999

[54] SEWING DATA PROCESSOR FOR PREPARING SEWING DATA FOR USE IN SEWING MACHINES

[75] Inventor: Yukiyoshi Muto, Nagoya, Japan

[73] Assignee: Brother Kogyo Kabushiki Kaisha, Nagoya, Japan

[21] Appl. No.: 661,981

[22] Filed: Jun. 12, 1996

[30] Foreign Application Priority Data

Jun. 15, 1995 [JP] Japan ..... 7-148556
May 7, 1996 [JP] Japan ..... 8-112353

[51] Int. Cl.[6] ..... G06F 19/00; D05B 21/00

[52] U.S. Cl. ..... 364/470.08; 364/470.07; 112/103; 112/475.02; 112/470.06

[58] Field of Search ..... 364/470.01, 470.06, 364/470.02, 470.03, 470.04, 470.07, 470.08, 470.09; 112/121.12, 103, 121.11, 262.3, 266.1, 102.5, 470.06, 470.07, 475.03, 475.04, 475.05, 475.19

[56] References Cited

U.S. PATENT DOCUMENTS

| | | | |
|---|---|---|---|
| 4,577,574 | 3/1986 | Takahashi | 112/121.12 |
| 4,622,907 | 11/1986 | Kimura | 112/121.12 |
| 4,919,062 | 4/1990 | Yokoe et al. | 364/470.08 |
| 5,181,176 | 1/1993 | Hayakawa | 112/121.12 |
| 5,231,941 | 8/1993 | Wakayama | 112/121.12 |
| 5,253,599 | 10/1993 | Hashiride | 112/121.12 |
| 5,319,565 | 6/1994 | Hausammann et al. | 364/470.02 |
| 5,357,442 | 10/1994 | Sekine | 364/470.08 |
| 5,537,945 | 7/1996 | Sugihara et al. | 364/470.08 |
| 5,592,891 | 1/1997 | Muto | 364/470.09 |

FOREIGN PATENT DOCUMENTS

| | | |
|---|---|---|
| A-60-119981 | 6/1985 | Japan . |
| A-3-128085 | 5/1991 | Japan . |
| A-4-174699 | 6/1992 | Japan . |
| A-5-49766 | 3/1993 | Japan . |
| A-5-76671 | 3/1993 | Japan . |
| A-6-44952 | 6/1994 | Japan . |

*Primary Examiner*—Reba I. Elmore
*Assistant Examiner*—Thomas E Brown
*Attorney, Agent, or Firm*—Oliff & Berridge, PLC

[57] ABSTRACT

A sewing data processor including input unit for inputting a sewing pattern to be sewn on a cloth using a sewing machine; sewing data preparation unit for preparing sewing data to be used in the sewing machine for sewing the sewing pattern, the sewing data preparation unit preparing the sewing data based on a predetermined point within a sewing reference frame encompassing the sewing pattern; and sewing reference frame setting unit capable of setting a sewable region of the sewing machine as the sewing reference frame.

13 Claims, 23 Drawing Sheets

SEWING DATA PROCESSOR FOR PREPARING SEWING DATA FOR USE IN SEWING MACHINES

BACKGROUND OF THE INVENTION

1. Field of the Invention

The present invention relates to a sewing data processor for preparing sewing data used in a sewing machine for sewing sewing patterns.

2. Description of the Related Art

U.S. Pat. Nos. 5,253,599, 5,181,176, and 4,622,907 describe sewing data processors having a microcomputer for preparing highly precise sewing data in a short time. These sewing data processors generally include a personal computer system including a mouse, a hard disk, and other components. An operator first inputs a sewing pattern by inputting contour lines of a figure using the mouse or a scanner. Then various settings, such as density of threads in the figure to be sewn, are set using a menu displayed on a display of the computer.

U.S. Pat. No. 5,231,941 describes a home sewing machine for embroidering based on sewing data prepared using a sewing data processor such as described in the above-referenced documents.

SUMMARY OF THE INVENTION

An example of a conceivable inputted sewing pattern is shown in FIG. 1(*a*). It is conceivable that the order of needle drop points, that is, of embroidery stitches, be represented by coordinate values of a coordinate system. In the example shown in FIG. 1(*a*), coordinate values of drop stitch points Q1, Q2, Q3 are part of a coordinate system having an origin (0,0) located at the lower-left corner of a rectangular mask or reference frame. The plurality of coordinate values, which represent the embroidery pattern, and the width and the height of the sewing reference frame are stored in a memory as embroidery data. The memory storing the embroidery data could be an embroidery card or a hard disk.

In the example shown in FIG. 1(*a*), the reference frame is in contact with the outward-most points of the embroidery pattern. A CPU of a sewing data processor could automatically compute such a sewing reference frame based on maximum and minimum values of the coordinate values representing needle drop points of the embroidery pattern. Alternatively, an operator could use a mouse to draw a rectangle that surrounds the embroidery pattern. In this later case, the operator would view the display and determine whether or not the rectangle surrounds the embroidery pattern based on his or her judgement. With this method, the range of the sewing reference frame is set without taking into consideration the maximum range that a sewing machine for embroidering the inputted pattern is capable of sewing.

To embroider using the sewing machine described in U.S. Pat. No. 5,231,941, a user inserts an embroidery (ROM) card into the sewing machine, whereupon a CPU of the sewing machine retrieves embroidery data from the embroidery card. It is conceivable that the sewing machine be connected directly to a sewing data processor by a transmission cable so that embroidery data can be transmitted from the sewing data processor to the sewing machine via the transmission cable.

It is conceivable that, as shown in FIG. 2(*a*), the sewing machine be provided with an embroidery frame 12 for supporting the cloth to be embroidered and a needle 41. A movement mechanism 12*a* is provided for supporting and moving the embroidery frame 12 with respect to the needle 41 within a sewing machine sewable region 38, which is the maximum region in which the sewing machine can sew and which is limited by capacity of the movement mechanism 12*a*. It is conceivable that, when embroidery data is provided to the sewing machine, the CPU of the sewing machine automatically performs layout procedures. A sewing reference frame 37 surrounding the embroidery pattern is centered in the sewable region 38. Said differently, the sewing machine automatically arranges the sewing reference frame 37 to a predetermined initial position regardless of whether the sewing reference frame 37 is set automatically or by an operator.

The sewing machine is also provided with an operation panel 13 including a small liquid crystal display (LCD) 110 and a transparent touch panel. The LCD 110 is small because it must be positioned in a small area at the front of the sewing machine and because a larger screen would greatly increase the price of the sewing machine. Because the LCD 110 is small, it is incapable of detailed display.

It is conceivable that the operation panel 13 displays a screen shown in FIG. 2(*b*) for changing the layout of the embroidery data. Because the LCD 110 is small, it displays only a few elements such as a rectangle 40 to represent the sewable region 38 and a blackened rectangle 39 to represent the sewing reference frame 37. Further, the LCD 110 also displays movement keys 35*a*, 35*b*, 35*c*, and 35*d* for moving the blackened rectangle 39 vertically and horizontally across the screen and a return key 36 for returning the layout to its original condition before being changed.

FIGS. 2(*a*) and 2(*b*) show the positional relationship of different elements directly after the embroidery data is retrieved by the sewing machine according to this possible modification. As shown in FIG. 2(*a*), the sewing reference frame 37 is laid out so that its center is positioned at the center of the sewable region 38. Similarly, as shown in FIG. 2(*b*), the rectangle 39 of the operation panel 13 is centered on the rectangle 40.

A user can change this layout by pressing one of the movements keys 35*a* through 35*d*. For example, when the key 35*a* is depressed, the rectangle 39 moves toward the left side of the operation panel 13 as shown in FIG. 3(*a*). As a result, as shown in FIG. 3(*b*), the embroidery frame 12 moves rightward with respect to the needle 41 and the sewable region 38 moves rightward also. Accordingly, the sewing reference frame 37 moves leftward with regards to the embroidery frame 12.

In this possible example, the initial layout of the sewing machine always has the sewing reference frame 37 centered in the embroidery frame 12. For this reason, an operator wants to embroider an embroidery pattern in a corner of the sewable region 38 in the embroidery frame 12, the operator must operate the movement keys 35*a* through 35*b* until the sewing reference frame 37 is positioned in the desired position in the corner of the sewable region 38.

Also in this possible example, to position the sewing reference frame 37 within the boundaries of the sewable region 38 of the sewing machine, an operator either looks directly at the needle 41 and the embroidery frame 12 or watches the rectangle 39 and the rectangle 40 on the operation panel 13. Accordingly, this method is unsatisfactory because an operator has no visual gauge to aid positioning. In other words, positioning of the sewable region 38 of the embroidery frame 12 and of the sewing reference frame 37 of the embroidery pattern is subjective. For this reason, even if an operator attempts to change the layout using the sewing machine, the operator will be unable to accurately position the embroidery pattern.

It is an objective to overcome the above-described problems and to provide a sewing data processor for preparing sewing data of a sewing pattern so that when sewing data is supplied to the sewing machine, its layout can be easily set using the sewing machine.

To achieve the above-described objectives, a sewing data processor according to the present invention includes input means for inputting a sewing pattern to be sewn on a cloth using a sewing machine; sewing data preparation means for preparing sewing data to be used in the sewing machine for sewing the sewing pattern, the sewing data preparation means preparing the sewing data based on a predetermined point within a sewing reference frame encompassing the sewing pattern; and sewing reference frame setting means capable of setting a sewable region of the sewing machine as the sewing reference frame.

With this configuration, a sewable region of a sewing machine is set as the sewing reference frame and sewing data for forming embroidery stitches of an inputted sewing pattern is prepared based on predetermined point within the sewing reference frame as a reference. Because the overall sewable region is set as the sewing reference frame, stitch positions are brought into direct association with the sewable region of the sewing machine. Positions where stitches are to be sewn in the sewable region can be indicated when preparing the sewing data. This means that positioning of the sewing pattern is determined and stored taking the sewable region into consideration. When the sewing pattern is sewn using the sewing machine, sewing can be started from a desired position without the operator having to move the sewing pattern.

According to another aspect of the invention, the sewing reference frame setting means is also capable of setting at least one of a smallest sewing reference frame capable of encompassing the sewing pattern and an optional sewing reference frame with size inputted via the input means. In this case, the sewing data processor can be further provided with a selection means for selecting as the sewing reference frame one of the sewable region of the sewing machine and at least one of a smallest sewing reference frame capable of encompassing the sewing pattern and an optional sewing reference frame with size inputted via the input means.

With this configuration, in addition to the sewable region, at least one of a smallest region capable of surrounding the sewing pattern and a region of optional size for surrounding the sewing pattern is selectively set as the sewing reference frame. Sewing data is prepared with reference to a predetermined point within the sewing reference frame corresponding to the selected setting method. Therefore, sewing data can be more freely prepared.

According to another aspect of the invention, the sewing data preparation means prepares sewing data for use in a sewing machine capable of, after positioning the sewing reference frame in a predetermined initial position, changing position of the sewing pattern within the sewing reference frame.

With this configuration, the sewing data preparation means prepares sewing data for use in a sewing machine capable of changing positions of the sewing pattern after first positioning a sewing reference frame at a predetermined initial position. Because the sewing data preparation means prepares the sewing data with the sewable region set as the sewing reference frame and based on a predetermined point within the sewing reference frame, embroidering can be started immediately at a desired position shifted from the predetermined initial position used by the sewing machine.

According to another aspect of the invention, the sewing data preparation means prepares sewing data for use in a sewing machine capable of changing position of the sewing pattern in relation to a border portion of the sewable region. Therefore, the sewing pattern can be accurately positioned in the sewing machine.

According to another aspect of the invention, the sewing data processor further includes a display for displaying at least one of the sewing pattern and a frame encompassing the sewing pattern and for displaying a gauge for assisting in positioning of the sewing pattern in the sewable region. Therefore, the sewing pattern can be accurately positioned while being prepared in the sewing data processor.

According to another aspect of the invention, the sewing data preparation means prepares sewing data for use in a sewing machine capable of combining a plurality of sewing patterns. When the sewing data preparation means prepares sewing data for use in a sewing machine capable of combining a plurality of sewing patterns, it is under the assumption that a user will combine sewing patterns in the sewing machine. Therefore, positioning of sewing patterns can be optionally decided so that positioning of sewing patterns in the sewing machine can be more easily performed. Particularly, when the sewing machine is of a type that first positions sewing patterns at a previously determined initial position, the sewing pattern can be positioned in a desired position when preparing the sewing data, without being effected by the initial positioning of the sewing machine.

BRIEF DESCRIPTION OF THE DRAWINGS

The above and other objects, features and advantages of the invention will become more apparent from reading the following description of the preferred embodiment taken in connection with the accompanying drawings in which:

FIG. 1(*b*) is a schematic view showing the embroidery pattern surrounded by an optional sewing reference frame set to an optional size by an operator;

FIG. 2(*b*) is a plan view showing an operation panel displaying a screen for changing position of an embroidery pattern with respect to the embroidery frame;

FIG. 3(*b*) is a perspective view showing the actual change in positional relationship between the embroidery pattern and the embroidery frame;

FIG. 13(*b*) is a schematic view showing an embroidery figure memory of the RAM of the sewing data processor;

FIG. 17(*b*) is a schematic view showing a menu displayed during a file menu routine of the menu button routine of FIG. 11;

DETAILED DESCRIPTION OF THE PREFERRED EMBODIMENTS

Figure 1:
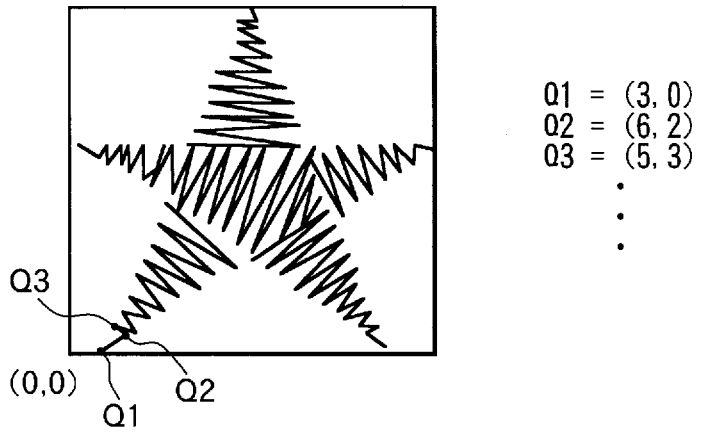
FIG. 1(*a*) is a schematic view showing an embroidery pattern surrounded by a smallest sewing reference frame capable of encompassing all points of the embroidery pattern.
Figure 1:
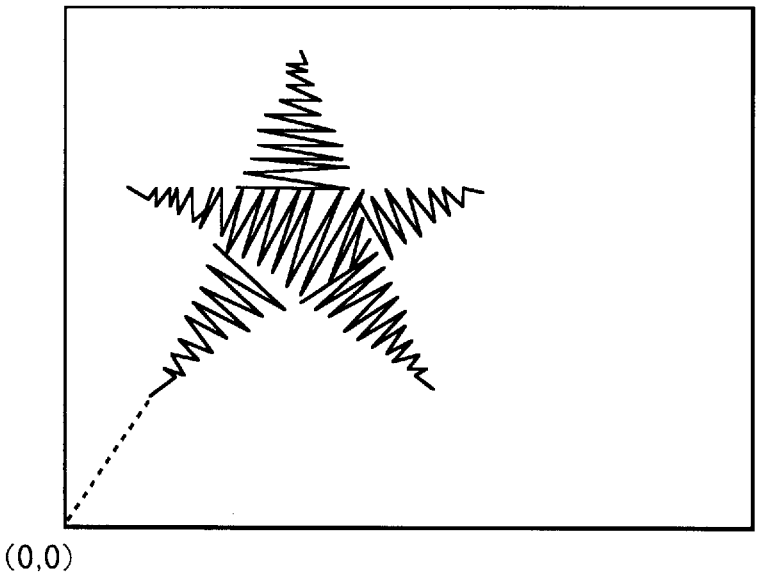

An embroidery data processor according to a preferred embodiment of the present invention will be described while referring to the accompanying drawings wherein like parts and components are designated by the same reference numerals to avoid duplicating description.

Figure 4:
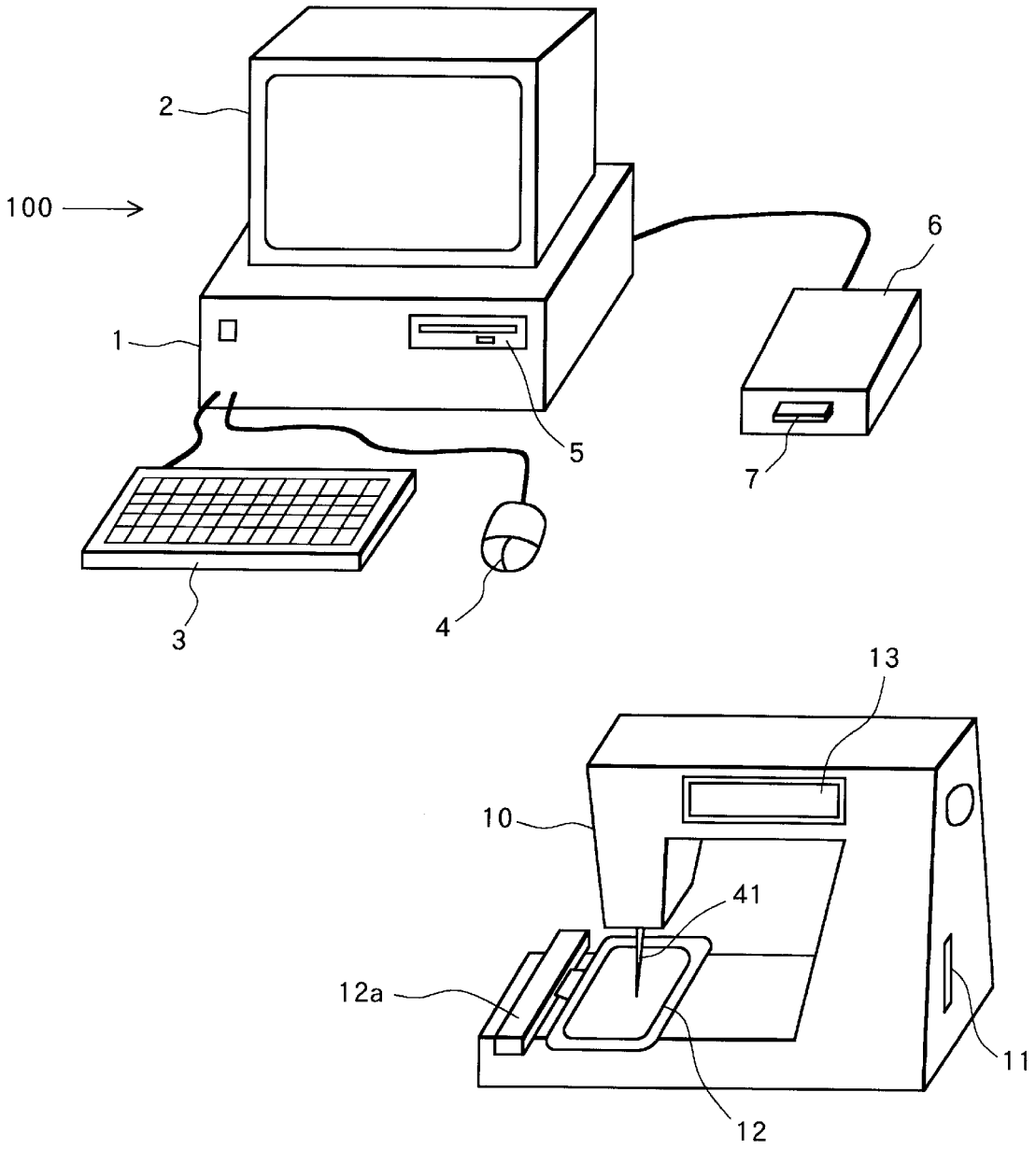
FIG. 4 is a perspective view showing a sewing data processor according to the present invention and a sewing machine using embroidery data prepared in the sewing data processor.

As shown in FIG. 4, an embroidery data processor 100 according to the present invention, includes a cathode-ray-tube (CRT) display 2 serving as a display means for displaying images, characters, and a gauge for positioning the images and the characters; a keyboard 3 and a mouse 4, serving as input means, for inputting coordinates of embroidery patterns and for selecting categories displayed on menu screens; an external input-output device 5 for storing and retrieving embroidery data prepared using the personal computer system 1; a flash memory 6 for writing embroidery data on an embroidery data card 7, which is made from a flash memory card; and a personal computer system 1 to which the above-described components are connected.

An embroidery pattern is inputted into the personal computer system 1 by operation of the keyboard 3, the mouse 4, an external memory such as the flash memory 6, or a scanner (not shown in the drawings). As will be described below, a sewing reference frame surrounding the embroidery pattern is designated before preparing embroidery data based on the inputted embroidery pattern. The resultant embroidery data is written on the flash memory card 7. The flash memory card can be inserted into a household embroidery sewing machine 10, where the embroidery data can be processed in a desired manner. The embroidery machine 10 has a similar configuration to the one described in U.S. Pat. No. 5,231,941, which is hereby incorporated by reference.

As shown in FIG. 4, an embroidery frame 12 for supporting a cloth to be embroidered is positioned on the bed of the sewing machines 10. A horizontal movement mechanism 12*a* is provided for moving the embroidery frame 12 to predetermine positions indicated by X and Y coordinates. The embroidery sewing machine 10 also includes a needle 41, a rotating hook mechanism (not shown in the drawings), and a flash memory unit 11 for reading embroidery data from the embroidery data card 7.

Figure 5:
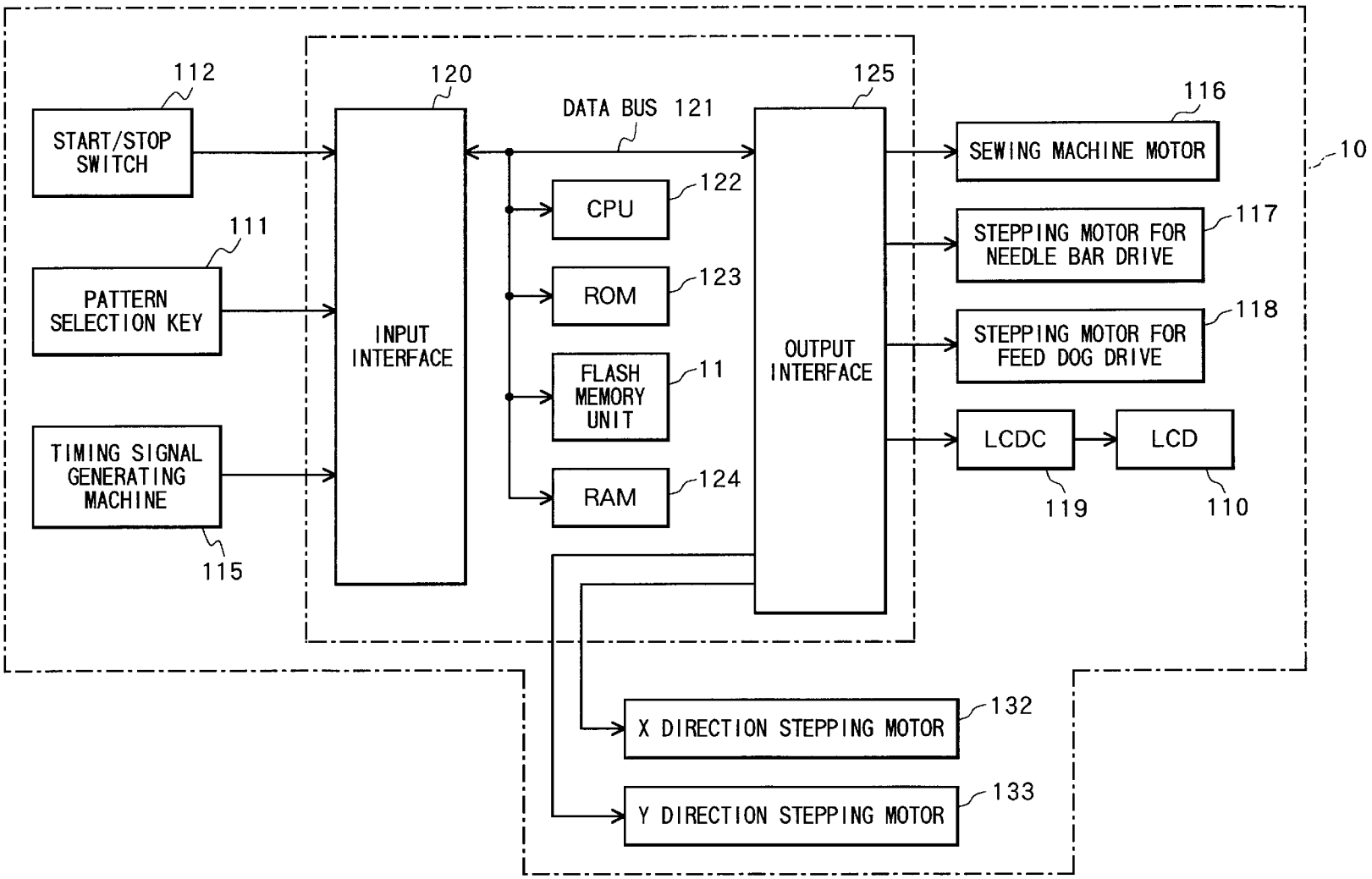
FIG. 5 is a block diagram showing essential components of the sewing machine of FIG. 4.

As shown in FIG. 5, a start and stop switch 112, a pattern selection key 111, and a timing signal generating machine 115 are connected to an input interface 120 of a control device C for the embroidery sewing machine 10. The timing signal generating machine 115 is installed near a sewing machine main shaft which is rotated by a sewing machine motor 116 and generates various timing signals including a needle upper position, a needle lower position, and so on. The sewing machine motor 116, a stepping motor of needle bar swing 117, a stepping motor of feed dog drive 118, and a display controller (LCDC) 119 for a display (LCD) 110 are connected to an output interface 125 of the control device C.

The control device C is comprised of a CPU 122, such as a microcomputer, the input interface 120, the output interface 125, a ROM 123, and a RAM 124, which are connected to CPU 122 through a bus such as a data bus 121.

A drive control program to drive the motors 116–118 and a display control program to display data on the display 110 are stored in ROM 123. A control program of warning message display control to display various warning messages in stitching embroidery patterns, the display data of various messages to display during the control program, and a plurality of identification data which are the same as the identification data stored in each of many ROM cards 126 for embroidery are also stored in the ROM 123. A pointer, a counter, or a buffer which temporarily store the operation result operated by the CPU 122 are in the RAM 124. An X-direction stepping motor 132 and a Y-direction stepping motor 133 are connected to a connector 134 of an embroidery device 130 as shown in FIG. 5.

The CPU controls the needle 41 and the rotating hook mechanism to perform sewing processes for embroidering a pattern while controlling the horizontal movement mechanism 12*a* to move the cloth to be embroidered. In this way, the cloth is embroidered with a predetermined pattern. So that it may perform this control operation, the flash memory unit 11 supplies the CPU embroidery data from the embroidery data card 7. The embroidery data indicates movement amounts (stitch positions) that the cloth is to be moved in the X and Y directions for each stitch so that embroidery operations can be automatically performed. The embroidery data processor 100 according to the present invention includes a function for preparing this type of embroidery data.

The embroidery sewing machine 10 is provided with an operation panel 13 formed from a liquid crystal display (LCD) 110 and a transparent touch panel (touch key). The embroidery sewing machine 10 is provided with a function for combining a plurality of optional embroidery patterns. A similar function is described in U.S. Pat. No. 4,622,907, which is hereby incorporated by reference. The embroidery data can be edited after storing it in an internal memory of the embroidery sewing machine 10 or in an external memory detachably mountable to the embroidery sewing machine 10.

Figure 2:
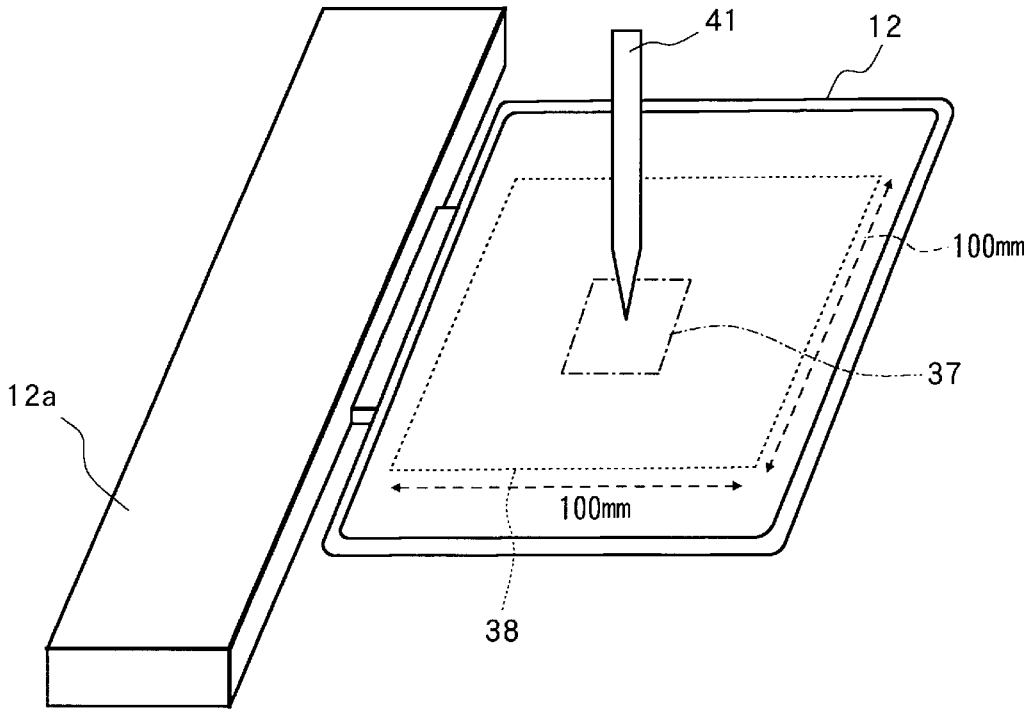
FIG. 2(*a*) is a perspective view showing relative position of a needle and an embroidery frame of a sewing machine for embroidering embroidery patterns in a fabric.
Figure 2:
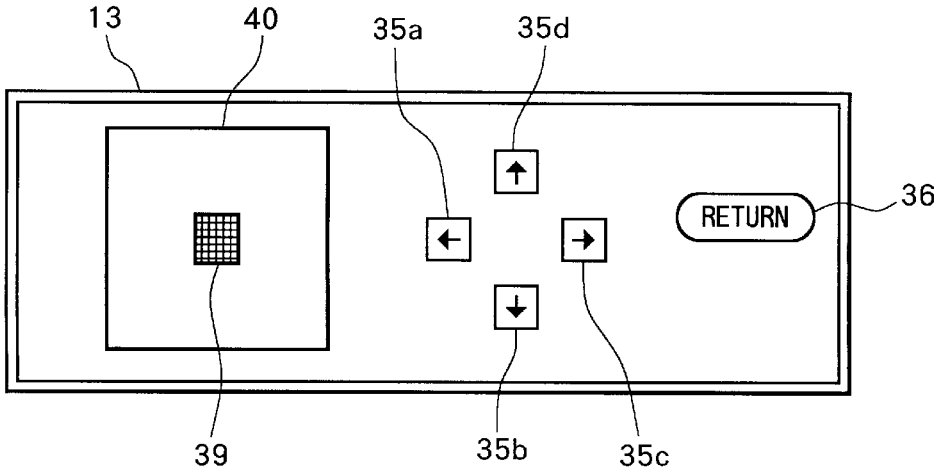
Figure 3:
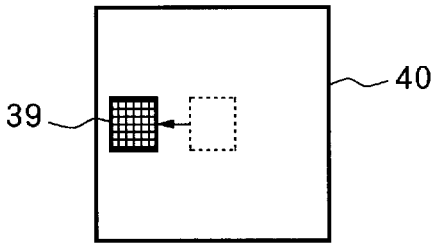
FIG. 3(*a*) is a plan view showing a portion of the operation panel displaying a screen representing a change in positional relationship between the embroidery pattern and the embroidery frame.
Figure 3:
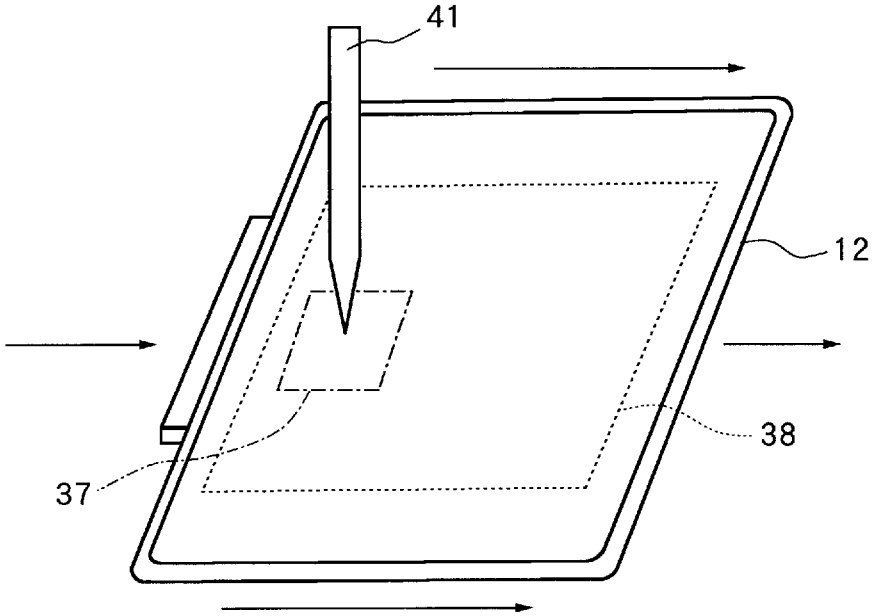

As explained with reference to FIGS. 2(*a*) and 2(*b*), when an embroidery pattern is selected, the embroidery sewing machine 10 positions the sewing reference frame 37 of the selected embroidery data in the center of the embroidery frame 12. Afterward, as explained with reference with FIGS. 3(*a*) and 3(*b*), an operator can use the movement operation keys 35*a* through 35*d* to change position where the embroidery pattern will be embroidered within the sewable region 38, which determines the region wherein embroidery is possible. The embroidery frame 12 moves relative to the needle 41 in association with operation of the movement keys 35*a* through 35*d*. The boundary of the sewable region 38 is displayed on a screen of the LCD 110 as the rectangle 40. An operator views the LCD 110 and the positional relation of the embroidery frame 12 and the needle 41 to subjectively determined the positioning of the embroidery pattern.

Figure 6:
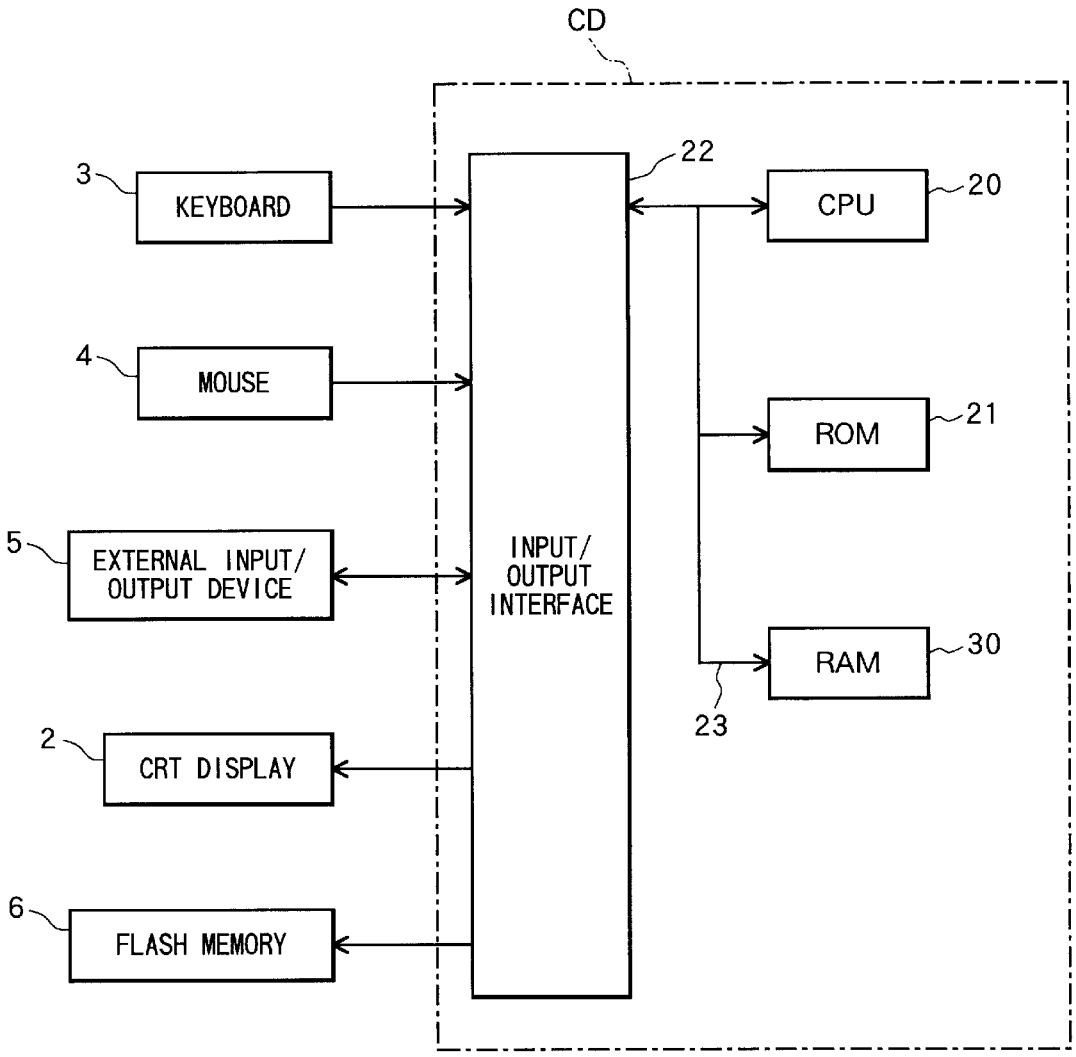
FIG. 6 is a block diagram showing essential components of sewing data processor of FIG. 4.

Next, an explanation of the control system of the embroidery data processor 100 will be provided while referring to the block diagram shown in FIG. 6. A control device CD is provided internally to the personal computer system 1. The control device CD includes a CPU 20, a ROM 21, a RAM 30, and an input/output interface 22, all connected via a bus 23, such as a data bus. The CRT display 2, the keyboard 3, the mouse 4, the external input-output device 5, and the flash memory 6 are all connected to the input/output interface 22.

Figure 7:
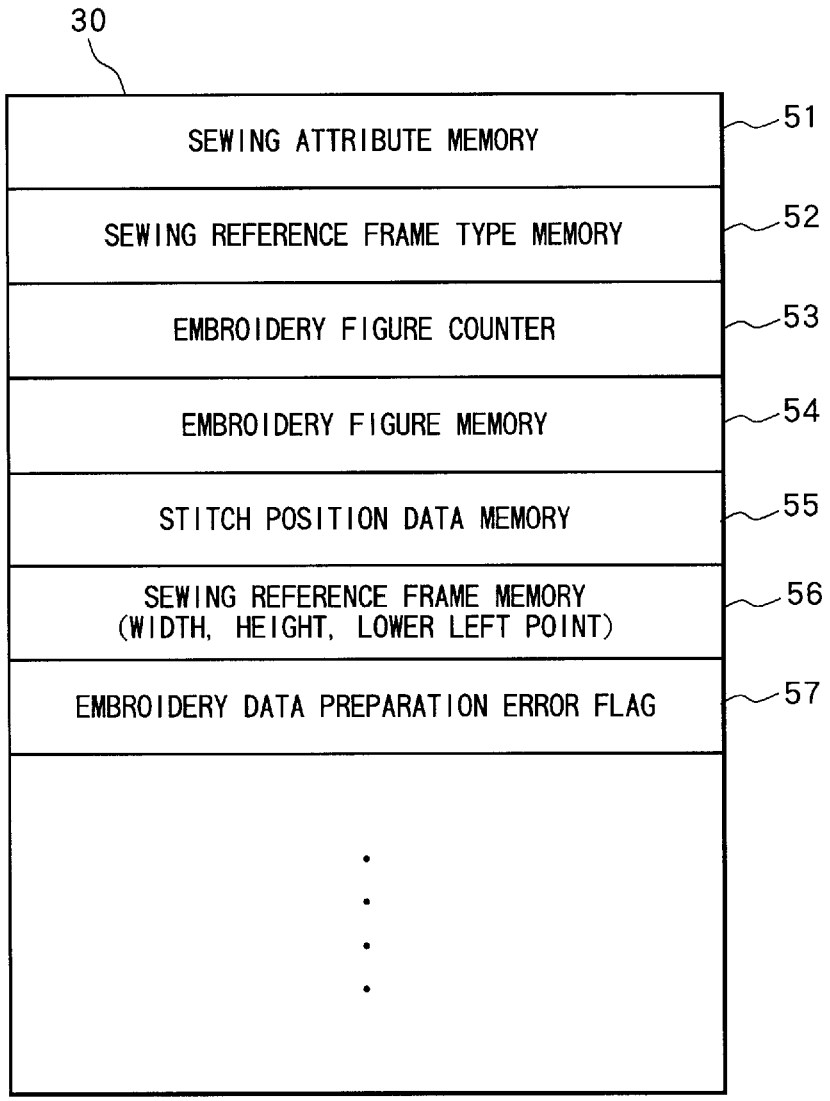
FIG. 7 is a schematic view showing a RAM of the sewing data processor.

As shown in FIG. 7, the RAM 30 includes various storage regions, such as a sewing attribute memory 51, a sewing reference frame type memory 52, an embroidery figure counter 53 storing a number representing a total number of embroidery patterns stored in an embroidery figure memory 54 and also representing the embroidery pattern presently being inputted, the embroidery figure memory 54 storing data for embroidery figures not yet converted into embroidery patterns with stitch points, a needle position data memory 55, a sewing reference frame memory 56, and an embroidery data preparation error flag 57.

Figure 8:
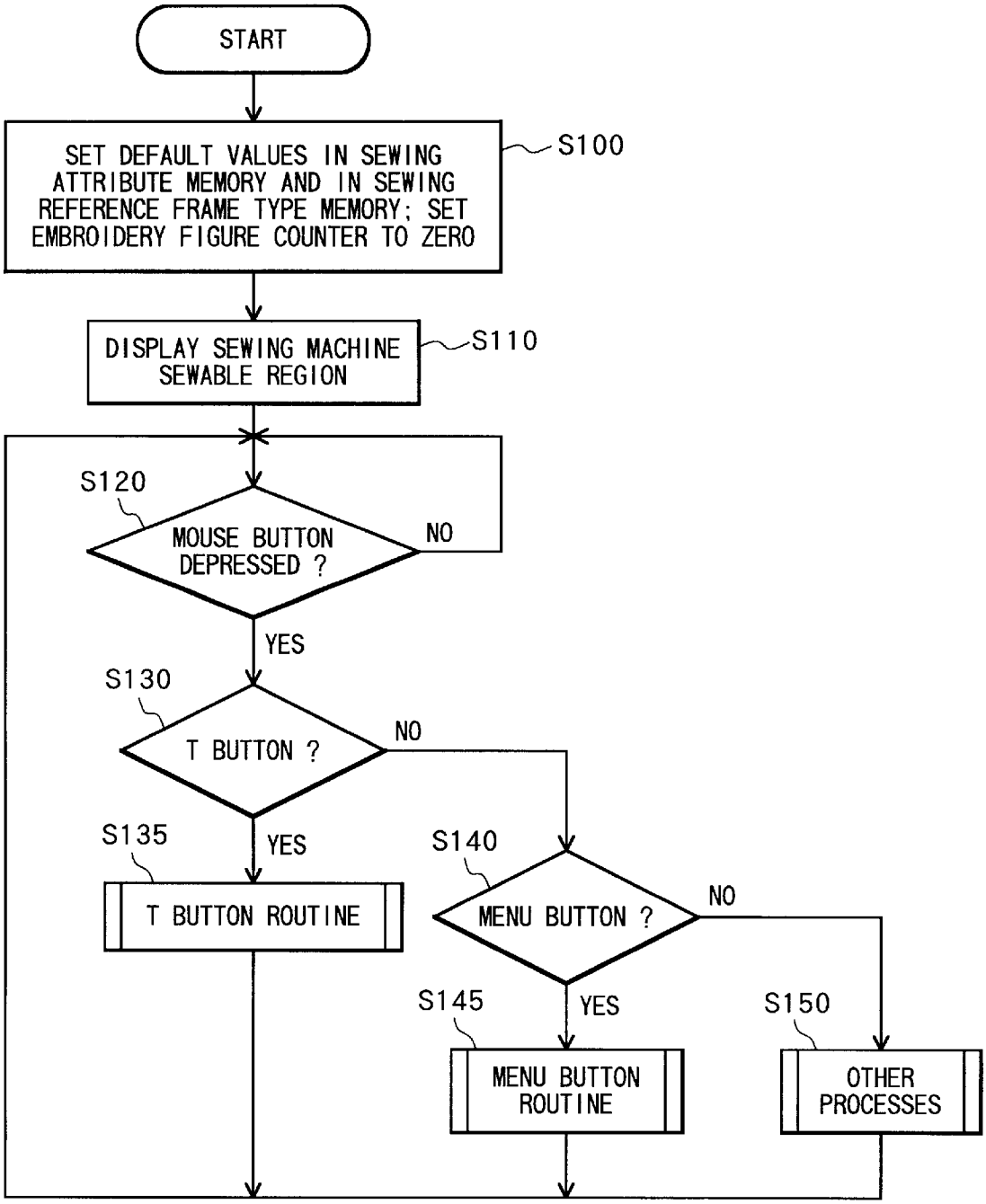
FIG. 8 is a flowchart representing a main routine of the sewing data processor.

Next, an explanation of operations of the embroidery data processor 100 will be provided while referring to the flowchart in FIG. 8.

This routine starts automatically when an operator inputs an execution command using the keyboard 3. First, in step 100, the CPU 20 automatically sets default values in the sewing attribute memory 51 and the sewing reference frame type memory 52. Also, the CPU 20 automatically sets the embroidery figure counter 53 to "0" because as of now no embroidery patterns have been stored in the embroidery figure memory 54. In the following text and in the drawings, individual steps will be indicated as Si, wherein i represents the number of an individual step.

Figure 9:
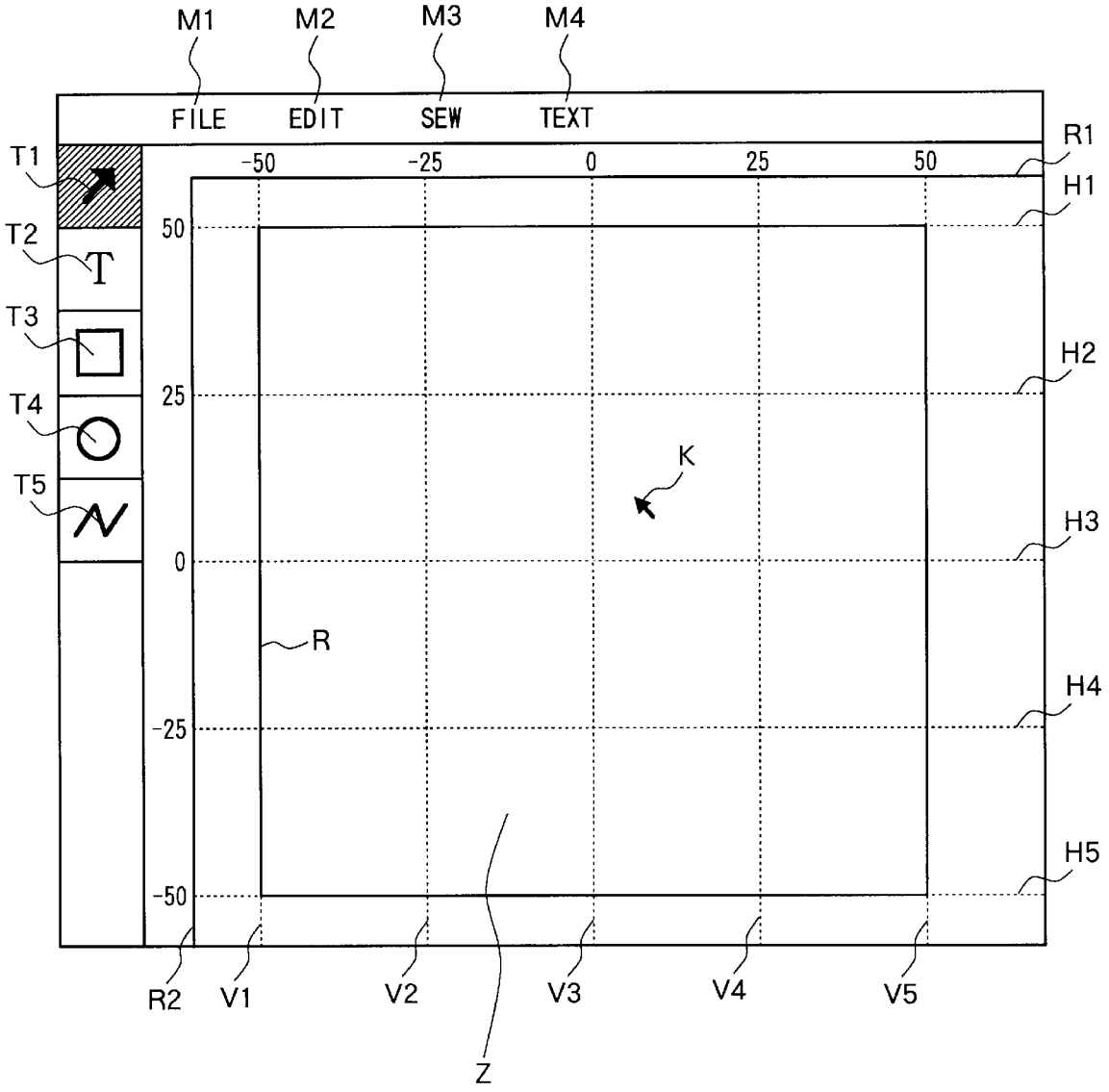
FIG. 9 is a plan view showing a display of the sewing data processor displaying an initial input screen for inputting embroidery patterns.

Next, in S110, an initial input edit screen shown in FIG. 9 is automatically displayed on the CRT display 2. The initial edit screen includes a work region Z that an operator refers to when inputting or positioning embroidery patterns; buttons T1 through T5 an operator uses when inputting and selecting shapes and figures to create desired embroidery patterns; and menu buttons M1 through M4 that an operator uses to display menus with categories relating to editing figures of the embroidery patterns, inputting and outputting files, and setting sewing attributes to figures of embroidery patterns.

A maximum rectangle R is displayed in the center of the initial input edit screen. The maximum rectangle R is displayed based on the default value of "0" in the sewing reference frame type memory 52 and serves as a display frame that corresponds to the size of the sewable region 38 of the embroidery sewing machine 10. The lower left vertex of the maximum rectangle R has coordinates of (−50, −50) and the opposing vertex in the upper right corner has coordinates of (50, 50). As a visual gauge for facilitating input and positioning of embroidery data, the initial input edit screen also includes a ruler R1 indicating coordinate values in the horizontal direction; a vertical line group V1 through V5 cutting through horizontal coordinates of the screen at a predetermined interval of 25 mm; a ruler R2 indicating coordinate values in the vertical direction; and horizontal lines H1 through H5 cutting through vertical coordinates of the screen at a predetermined interval of 25 mm.

The buttons T1 through T5 include a button T1 for selecting desired embroidery figures; a button T2 for inputting embroidery patterns of characters such as alphanumeric characters; a button T3 for inputting square and rectangular embroidery patterns; a button T4 for inputting circular and ellipsoidal embroidery patterns; and a button T5 for inputting embroidery patterns formed from figures encompassed, or defined, by a plurality of line segments.

The menu buttons M1 through M4 include a file menu button M1 for displaying a menu with categories relating to input and output of files; an edit menu button M2 for displaying a menu with categories relating to editing operations; a sew menu button M3 for displaying a menu with categories for setting attributes for sewing: and a text menu button M4 for displaying a menu with categories relating to embroidery of characters.

Next, in S120, whether or not the mouse button has been depressed is determined. When the mouse button is depressed (S120:YES), then it is determined that input has been received from an operator. The position of the mouse cursor K is determined in S130, S140, and S150 and appropriate processes shown in FIGS. 10 and 11 are performed depending on the position of the mouse cursor K.

Figure 10:
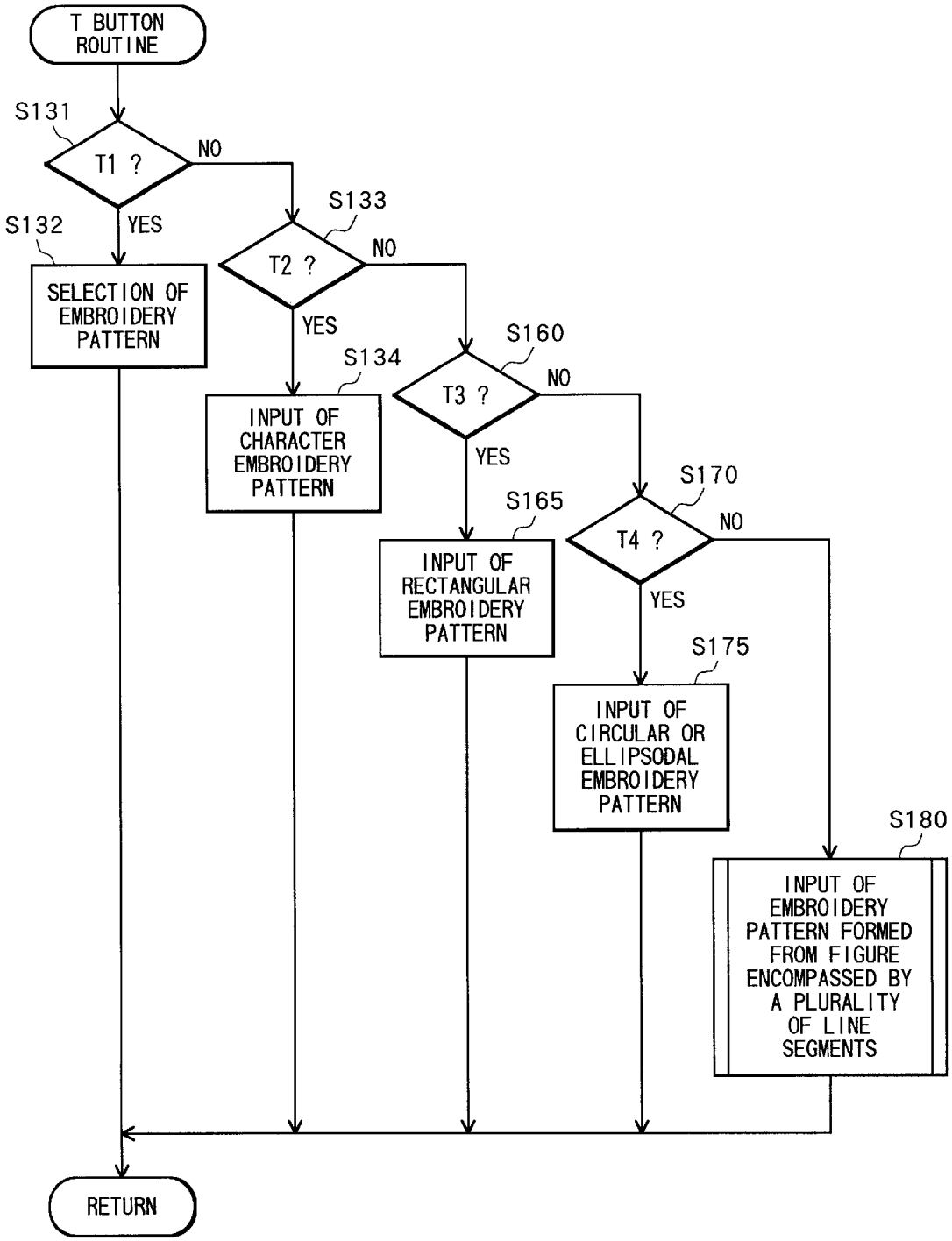
FIG. 10 is a flowchart representing a T button routine of the main routine.

When it is determined that the operator has indicated one of the buttons T1 through T5 (S130:YES), then a T button routine represented by the flowchart in FIG. 10 is performed. At the start of the T button routine, the position of the mouse cursor K is automatically determined in S131, S133, S160, and S170 and appropriate processes are automatically performed. When the position of the mouse cursor K is over button T1 when the mouse button is depressed (S131:YES), then a selection routine is performed in S132 regarding previously inputted embroidery figures. On the other hand, when the mouse cursor K is over the button T2 (S133:YES), then in S134 processes for inputting embroidery patterns of characters are performed. When the mouse cursor K is over the button T3 (S160:YES), then in S165 processes for inputting rectangular embroidery patterns are performed. When the mouse cursor K is over the button T4 (S170:YES), then in S175 processes for inputting circular and ellipsoidal embroidery patterns are performed. When the mouse cursor K is over the button T5 (S170:NO), then in S180 processes for inputting embroidery patterns formed by figures encompassed by plurality of line segments are performed.

Figure 11:
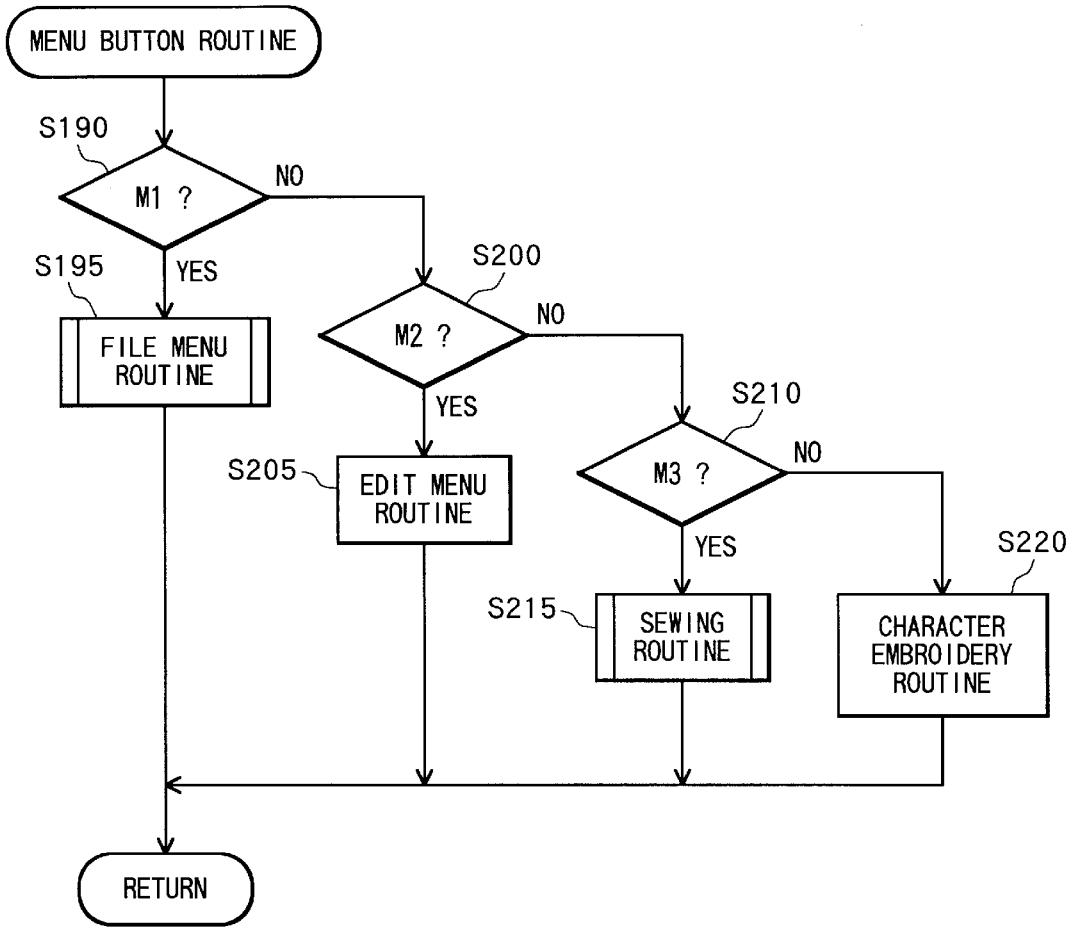
FIG. 11 is a flowchart representing a menu button routine of the main routine.

When the operator indicates one of the menu buttons M1 through M5 (S130:NO, S140:YES), then the position of the mouse cursor K is determined and appropriate processes are automatically performed via S190 through S220 shown in FIG. 11. When it is determined that the mouse cursor K is positioned over the menu button M1 when clicked (Sl90:YES), then processes, such as display of a menu with categories relating to file operations, are performed in S195. When the cursor mouse K is positioned over the menu button M2 when clicked (S200:YES), then processes, such as display of a menu with categories relating to editing, are performed in S205. When over the sew menu button M3 (S210:YES), then processes, such as display of a menu with categories relating to sewing, are performed in S215. When over the menu button M4 (S210:NO), then processes, such as display of a menu with categories relating embroidery of characters, are performed in S220.

Next, an explanation of operations for preparing embroidery data will be provided using an inputted star-shaped figure as an example.

Figure 12:
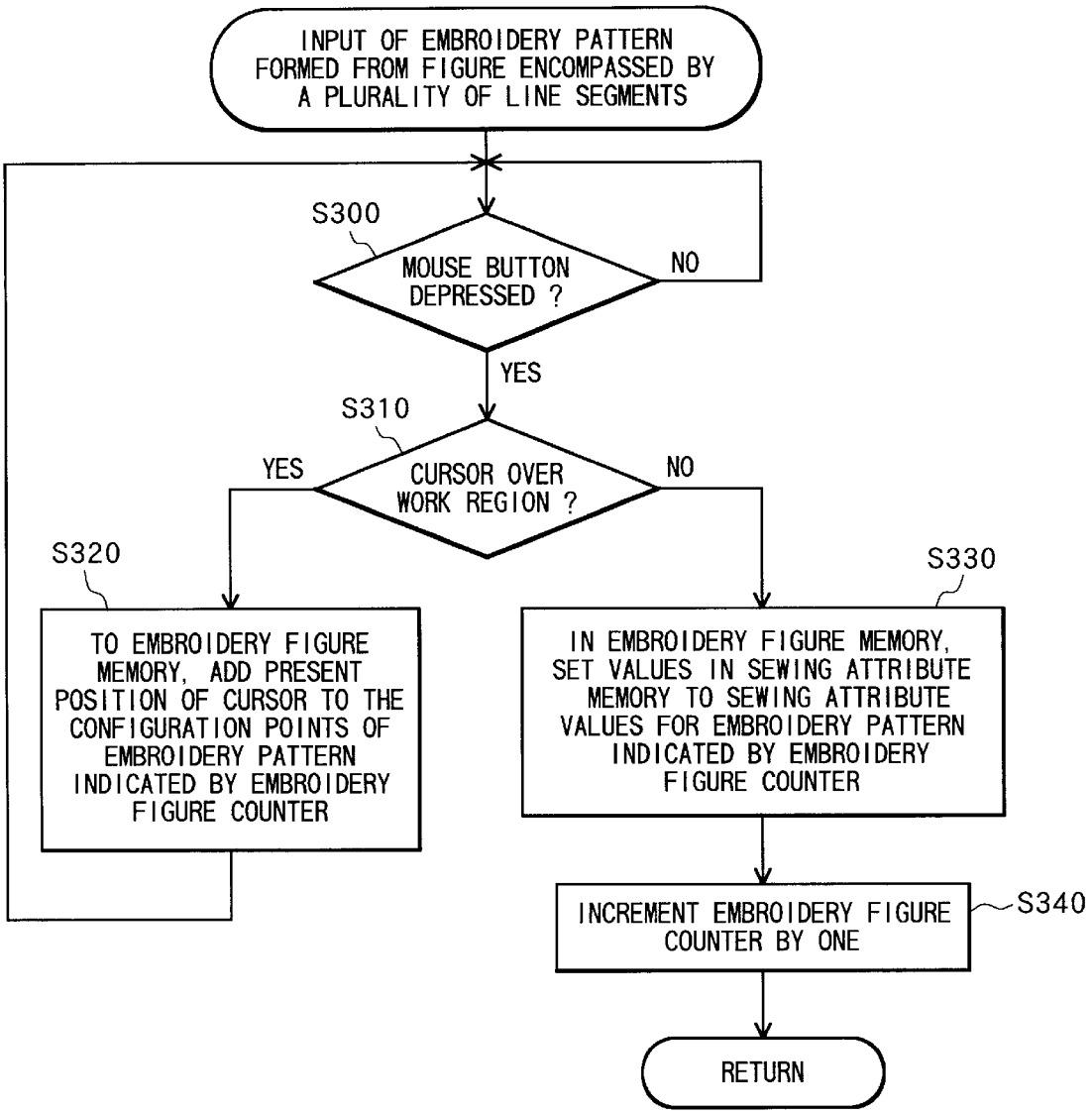
FIG. 12 is a flowchart representing a routine of the main routine for inputting embroidery patterns formed from a figure defined by a plurality of line segments.
Figure 13:
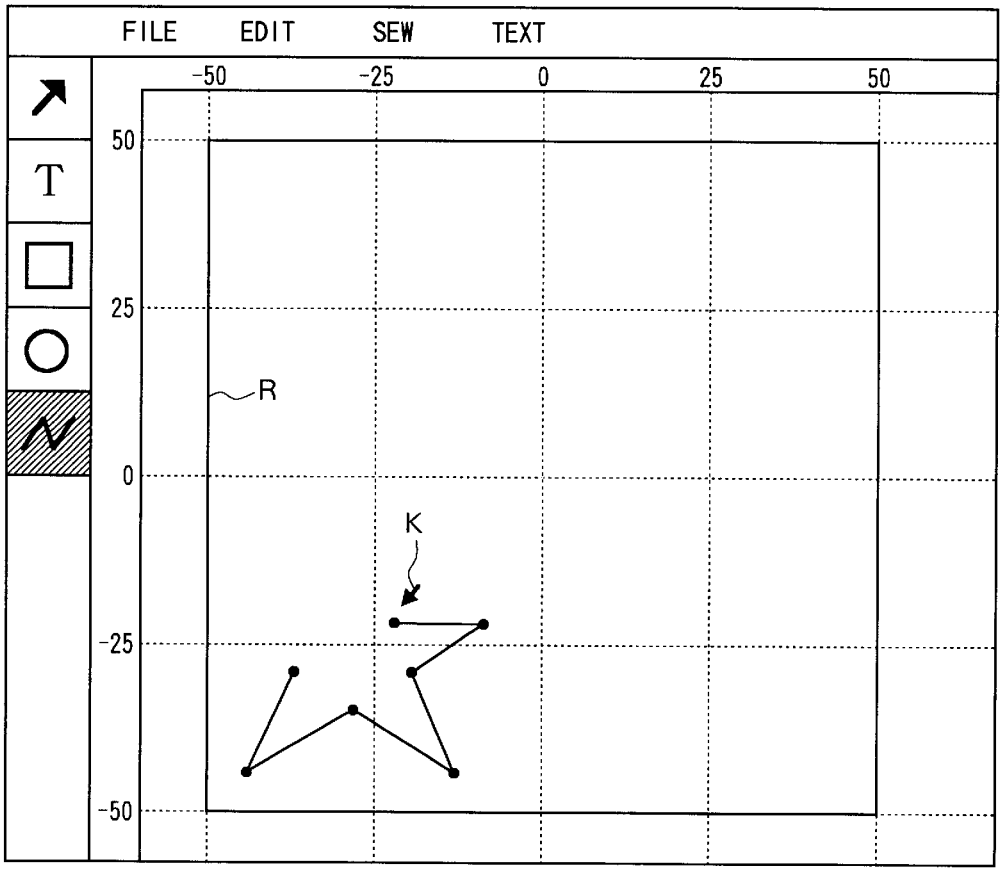
FIG. 13(*a*) is a plan view showing the display during input of a star-shaped embroidery pattern.
Figure 13:
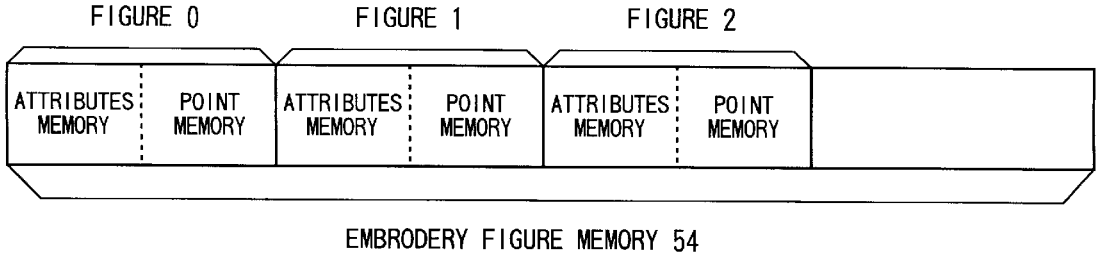

When the mouse button is depressed (S120:YES) while the mouse cursor K is positioned over the button T5 (S130:YES, S140:NO, S150:NO, S160:NO, S170:NO), then a routine for inputting embroidery patterns formed by figures encompassed by a plurality of line segments and represented by the flowchart shown in FIG. 12 is executed in S180. In the following example, it will be assumed that the operator is inputting a new embroidery pattern. When this routine is started, the position of the mouse cursor K is automatically determined. As shown in FIG. 13(*b*), the embroidery figure memory 54 includes an attribute memory and a point memory for each inputted figure. When the operator moves the position of the mouse cursor K to the work region Z and depresses the mouse button (S300:YES, S310:YES), then in S320 the present position of the mouse cursor K is added to the embroidery figure memory 54 to a point memory corresponding with the number of the embroidery figure presently being inputted. It should be noted that which embroidery pattern is presently being inputted is determined by referring to the value in the embroidery figure counter 53. For example, when the value of the embroidery figure counter 53 is 0, then the presently inputted embroidery pattern is a first embroidery pattern. Then the program returns to S300 to await further input from the mouse 4. When another point is additionally inputted to edit the embroidery pattern, the processes of S320 are repeated.

When the mouse button is clicked while the mouse cursor K is not positioned in the work region Z (S310:NO), it is determined that input of configuration points has been completed. Therefore, any sewing attributes inputted by the operator are set to the inputted figure in S330. That is, the values set in the sewing attribute memory 51 are set in the embroidery figure memory 54 in the attribute memory corresponding to the embroidery figure indicated by the value stored in the embroidery figure counter 53 as attributes of the inputted embroidery pattern. Afterward, the value of the embroidery pattern counter 53 is incremented by one in S340 and the program returns to the position after S180. In this way, pattern input and attribute setting processes are completed for one embroidery pattern.

Figure 14:
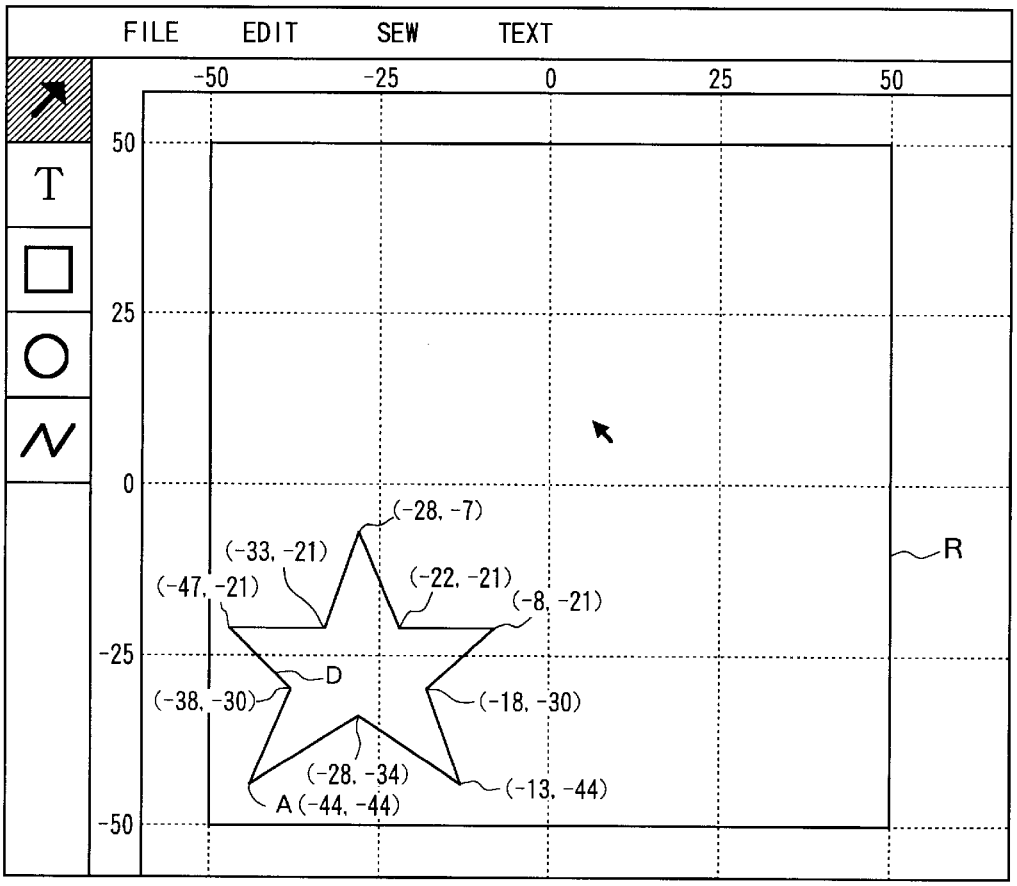
FIG. 14 is a plan view showing the display after all points of the star-shaped embroidery pattern have been inputted.
Figure 15:
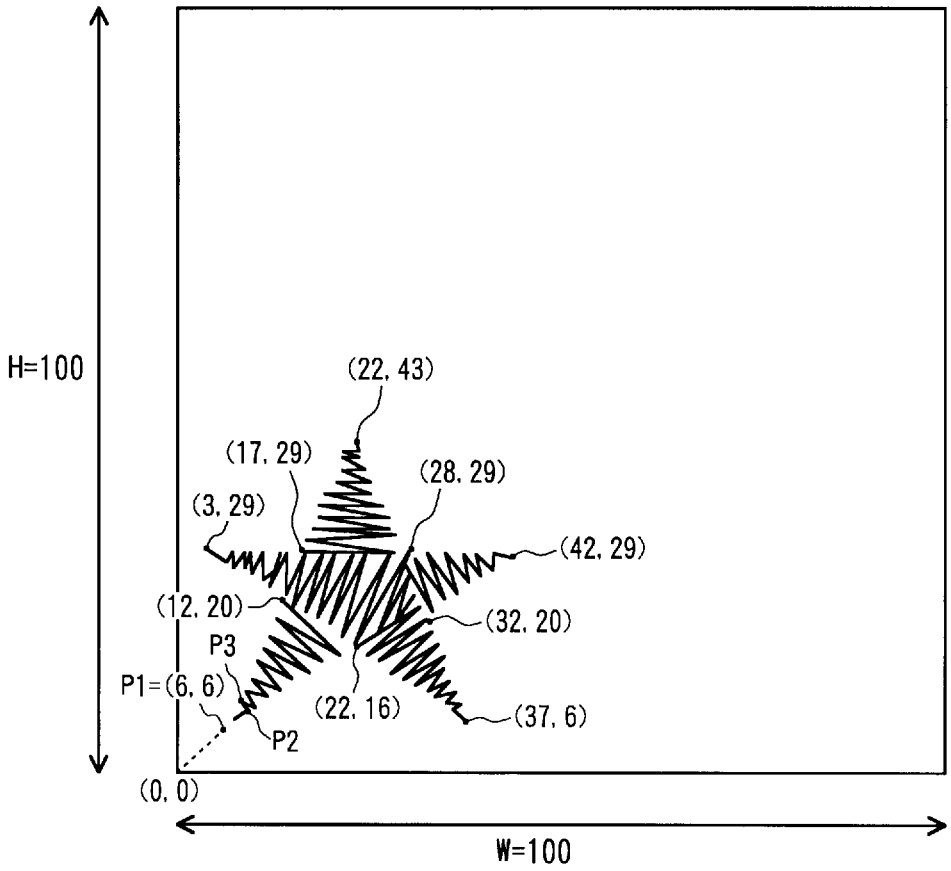
FIG. 15 is a plan view showing the embroidered star-shaped embroidery pattern.

Here, an example for preparing embroidery data for a star-shaped embroidery pattern will be provided while referring to FIGS. 13(*a*) through 15. First, an operator uses the mouse cursor K to select button T5 and, as shown in FIG. 13(*a*), to indicate vertices of angled corners of the star. After input of all five vertices is completed, the finished star-shaped embroidery pattern D appears as shown in FIG. 14. Although the star-shaped embroidery pattern D appears as only the outline of a star on the display, it is actually set with attributes, such as the type of stitch, that is, a mat-type stitch or satin stitch, or the thread density. When the star-shaped embroidery pattern is actually sewn using the embroidery sewing machine 10. the attributes are used to develop the internal portion of the star pattern as shown in FIG. 15. Configuration points, or stitch points, and sewing attributes of the star-shaped embroidery pattern D are stored in the embroidery figure memory 54.

It should be noted that although it was described above that the sewing attribute memory 51 and the sewing reference frame type memory 52 are set with default values in S100, this process can be modified in the following manner.

Figure 16:
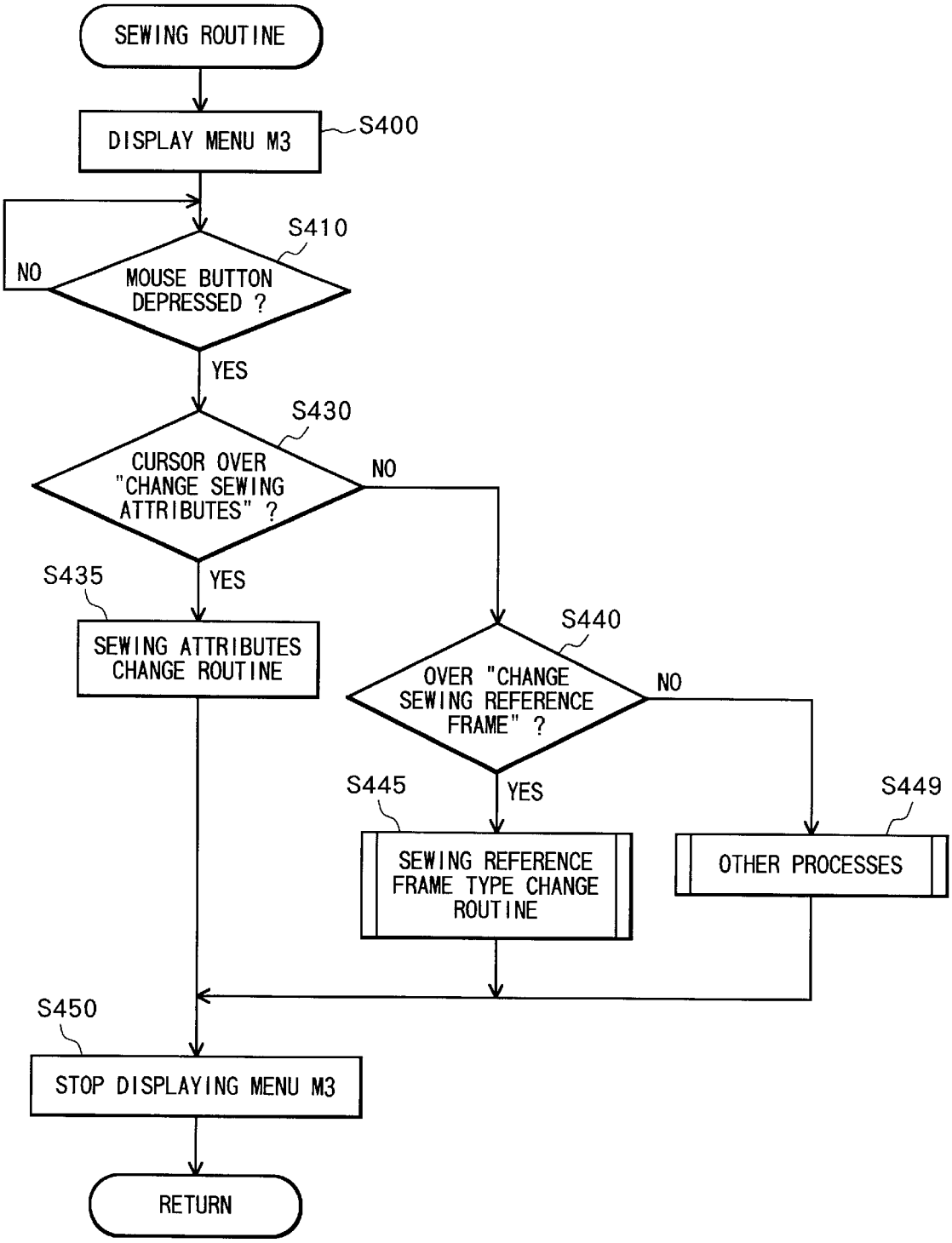
FIG. 16 is a flowchart representing a sewing routine of the menu button routine shown in FIG. 11.

When the mouse cursor K is moved to the position of the menu button M3 and the mouse button clicked (S120:YES, S190:NO, S200:NO, S210:YES), then a sewing routine shown in FIG. 16 is performed in S215.

Figure 17:
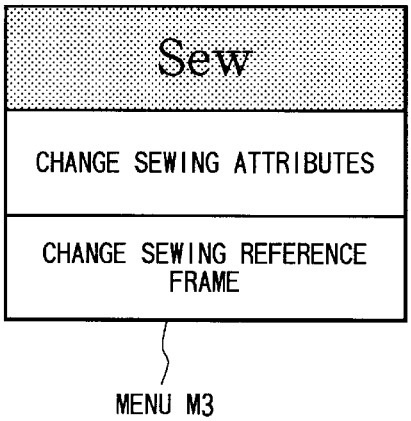
FIG. 17(*a*) is a schematic view showing a menu displayed during the sewing routine of FIG. 16.
Figure 17:
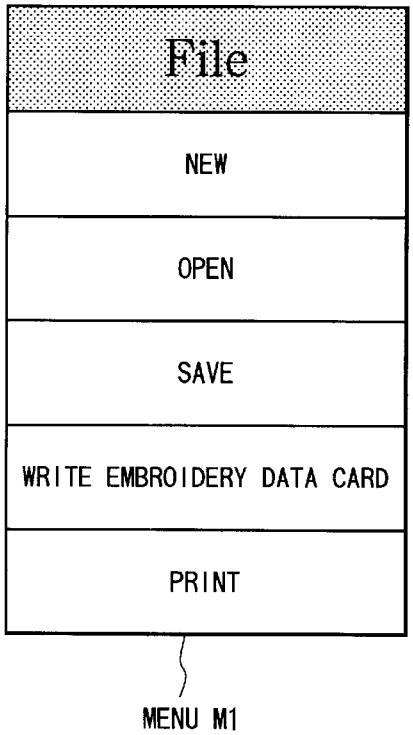
Figure 18:
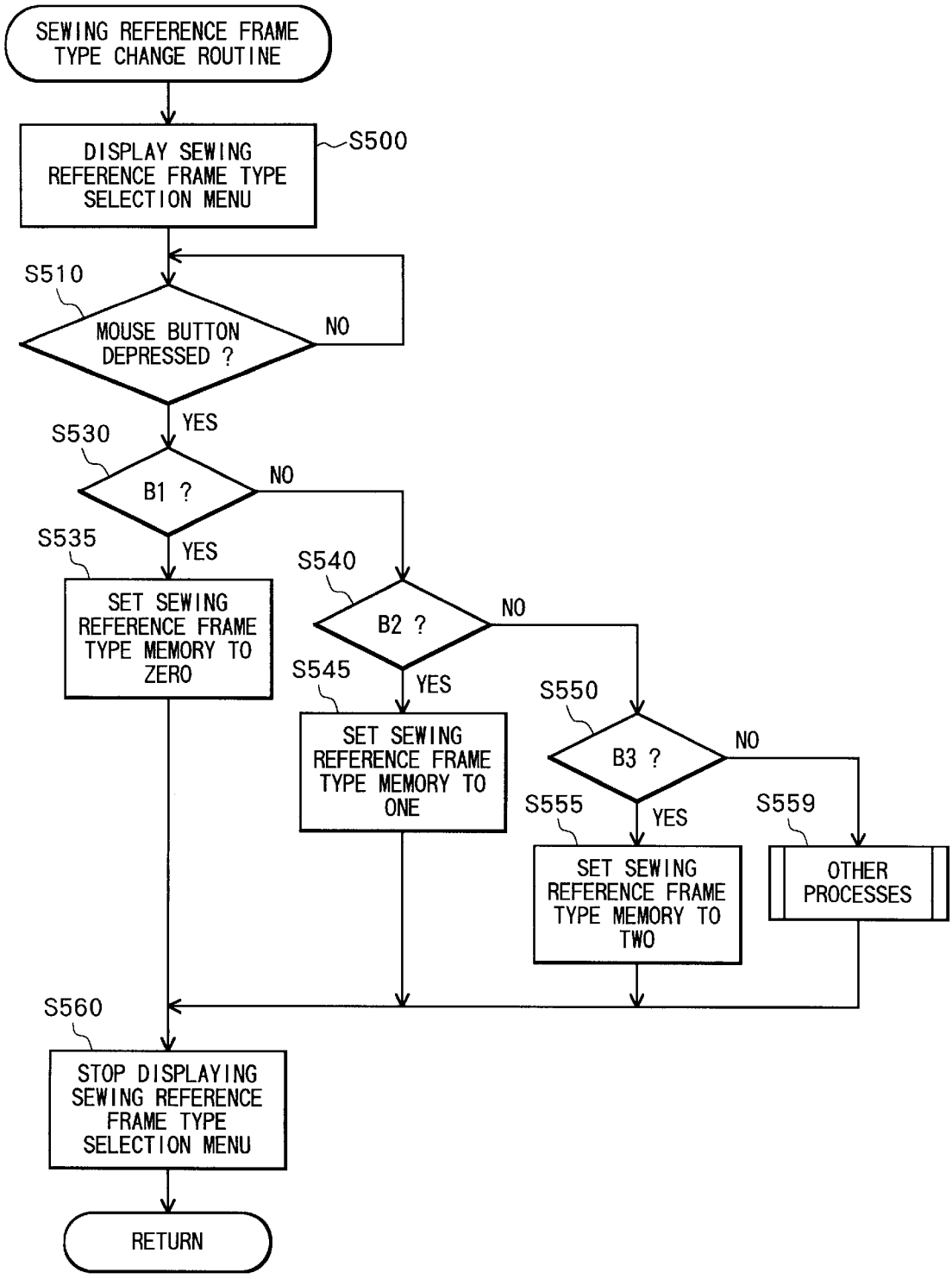
FIG. 18 is a flowchart representing a sewing reference frame type change routine of the sewing routine shown in FIG. 16.

When the sewing routine is started, first the menu shown in FIG. 17(*a*) is displayed in S400 overlapping the previous screen. Next, when the mouse button is clicked (S410:YES), then the position of the mouse cursor K is automatically determined. When the mouse button was clicked while the mouse cursor K was positioned over the "CHANGE SEWING ATTRIBUTES" category of the menu (S430:YES), then in S435 the program enters a sewing attributes change routine for changing values in the sewing attribute memory 51. This routine allows a user to change sewing attributes of the embroidery pattern to new ones. On the other hand, when the mouse button is pressed while the mouse cursor K is positioned over the "CHANGE SEWING REFERENCE FRAME" category of the menu (S440:YES), then a sewing reference frame type change routine shown in FIG. 18 is performed in S445.

Figure 19:
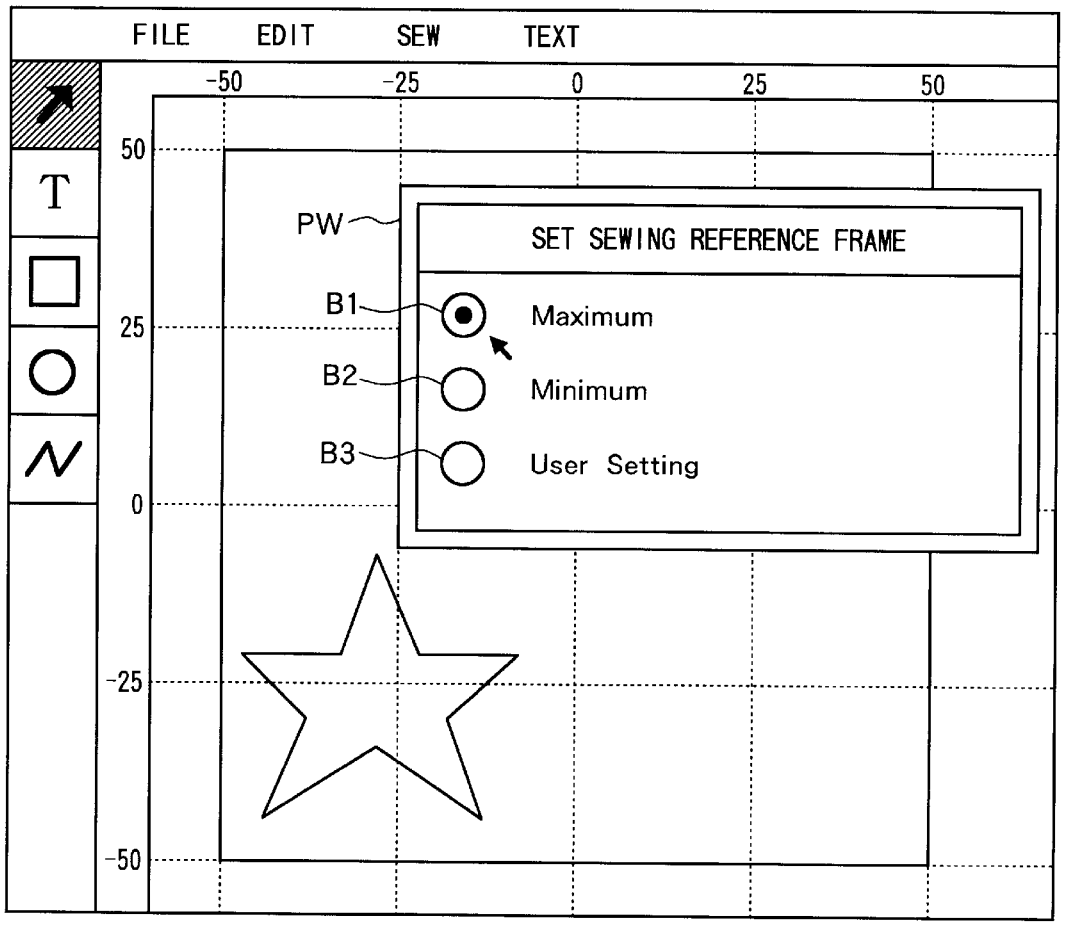
FIG. 19 is a plan view showing a menu displayed during the sewing reference frame type change routine of FIG. 18.

When the program proceeds to this routine, first a menu PW shown in FIG. 19 is automatically displayed in S500 overlapping the previous screen. Three buttons are displayed in this menu: a maximum button B1, a minimum button B2, and a user setting button B3. The center of the button corresponding to the value presently stored in the sewing reference frame type memory 52 is displayed with a blackened center. In the example shown in FIG. 19, the maximum button B1 corresponds to the value presently stored in the sewing reference frame type memory 52 and so is displayed with its center blackened. It should be noted that when the button B2 is selected during the sewing reference frame type change routine of S445, the sewing reference frame will be set to appear as shown in FIG. 1(*a*). On the other hand, when the button B is selected, the sewing reference frame will be set to appear as shown in FIG. 1(*b*).

Next, when the mouse button is clicked (S510:YES), the position of the mouse cursor K is automatically determined and appropriate processes are performed in S530 through S560. When the mouse button is clicked while the mouse cursor K is positioned over the button B1 (S530:YES), then the sewing reference frame type memory 52 is set to 0 in S535. When the mouse button is clicked while the mouse cursor K is positioned over the button B2 (S540:YES), then the value of the sewing reference frame type memory 52 is set to 2 in S555. When the mouse button is clicked while the mouse cursor K is positioned over the button B3 (S550:YES), then the value of the sewing reference frame type memory 52 is set to 2. Afterward, display of the menu PW is automatically stopped in S560 and the program returns to after S445.

When the value of the sewing reference frame type memory 52 is set to 0, this means that a maximum rectangle R corresponding to the sewable region 38 is set as the sewing reference frame. A setting of 1 means that, as shown in FIG. 1(*a*), the smallest rectangular shape capable of completely surrounding the embroidery pattern is set as the sewing reference frame. A setting of 2 means that a user uses the mouse to draw a rectangle within the work region Z to surround the embroidery pattern and then sets that rectangle as the sewing reference frame as shown in FIG. 1(*b*).

Next, an explanation of procedures for preparing embroidery data and writing the data on an embroidery data card will be provided.

Figure 20:
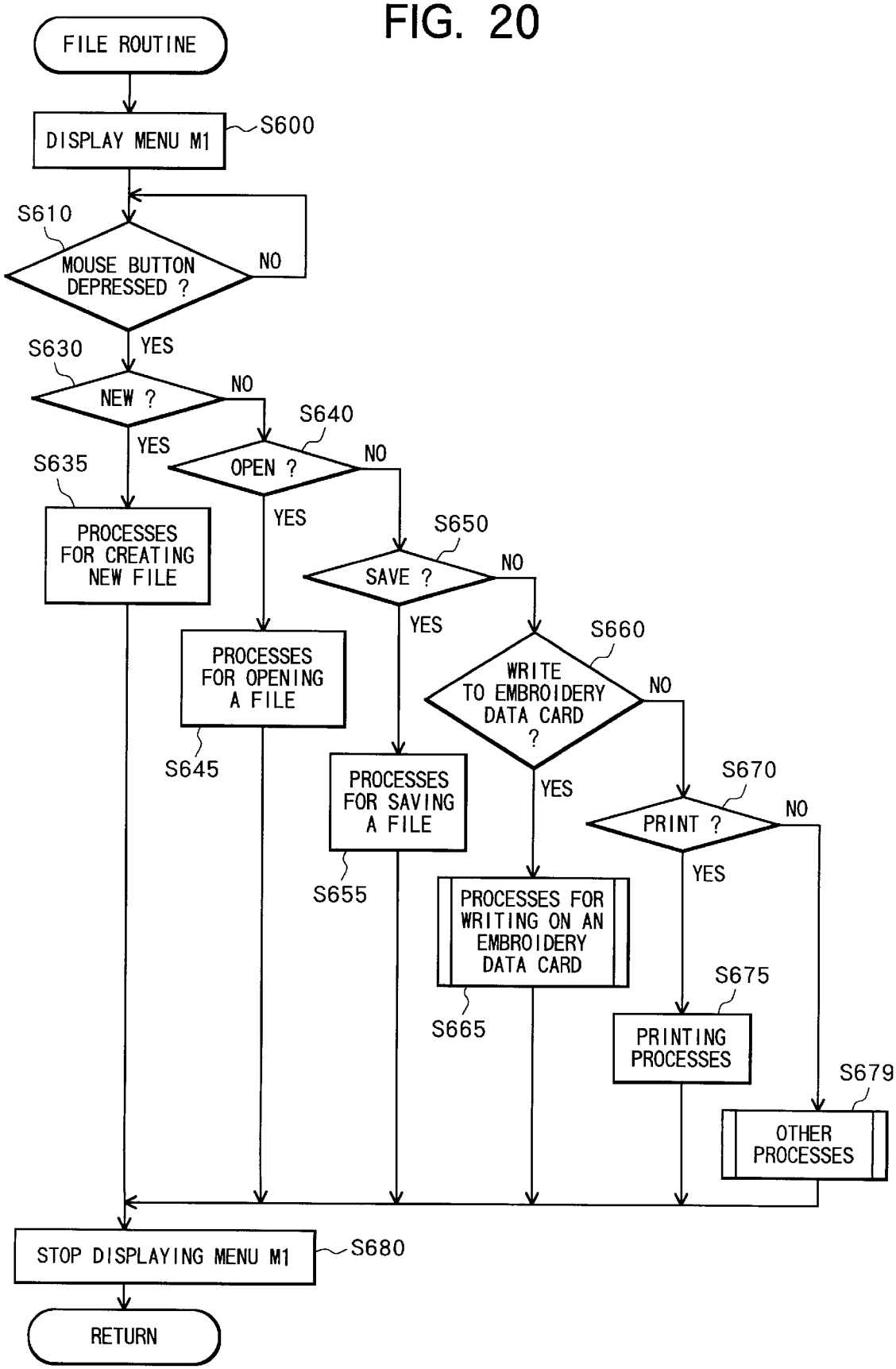
FIG. 20 is a flowchart representing the file routine for displaying the menu of FIG. 17(*b*)

When the mouse button is clicked while the mouse cursor K is positioned over the menu button M1 so that S190 of FIG. 19 results in a positive determination, then in S195 a file menu routine represented by the flowchart of FIG. 20 is performed.

Figure 21:
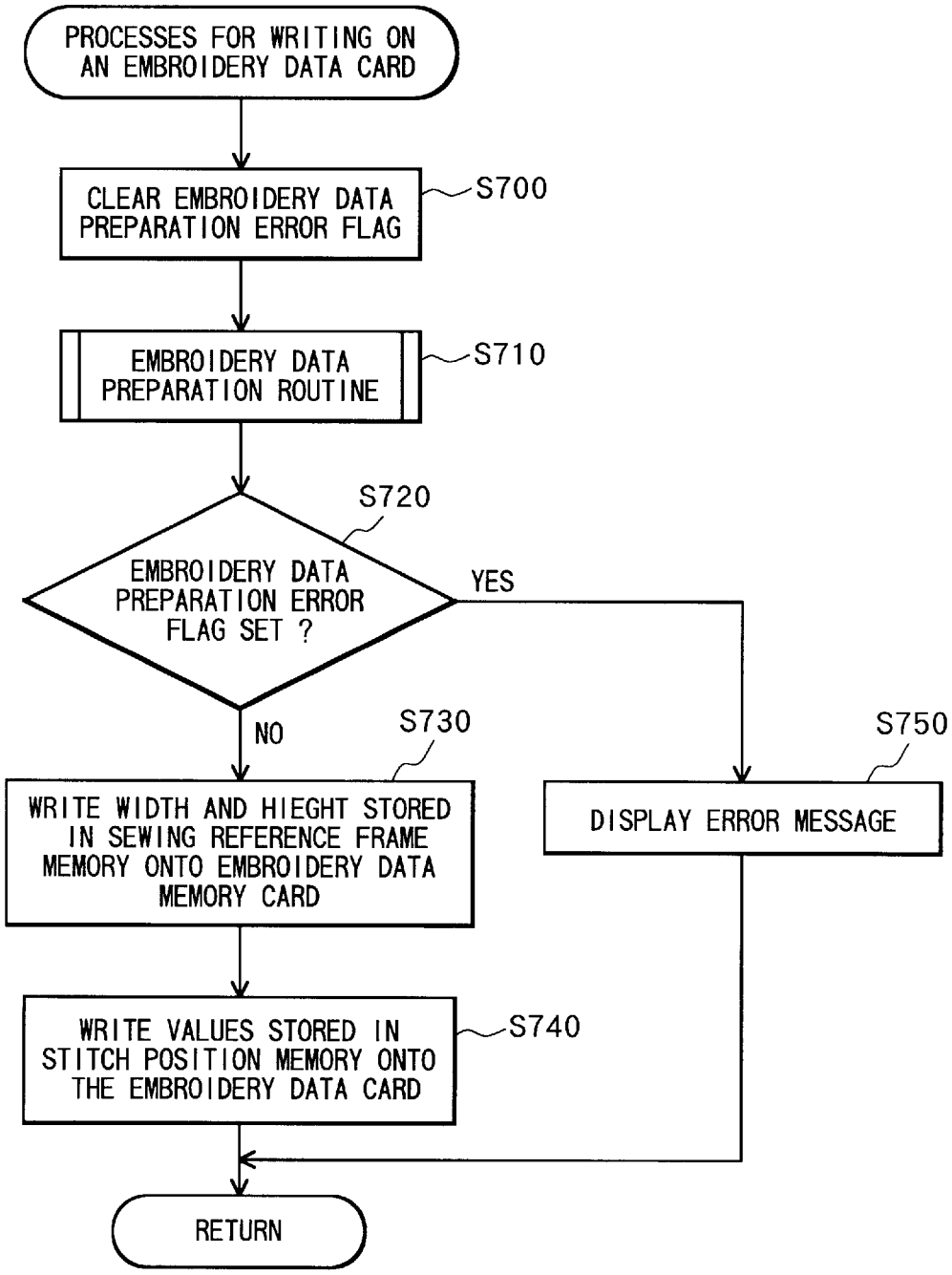
FIG. 21 is a flowchart representing a routine of the file routine of FIG. 20, the routine including processes for writing an embroidery data card.

When this routine starts, first the menu shown in FIG. 17(*b*) is displayed on the display in S600. When the user moves the mouse cursor K over the "WRITE EMBROIDERY DATA CARD" category of the menu and presses the mouse button (S610:YES, S660 through S650:NO, S660:YES), then in S665 an embroidery data card writing routine represented by the flowchart of FIG. 21 is performed.

Figure 22:
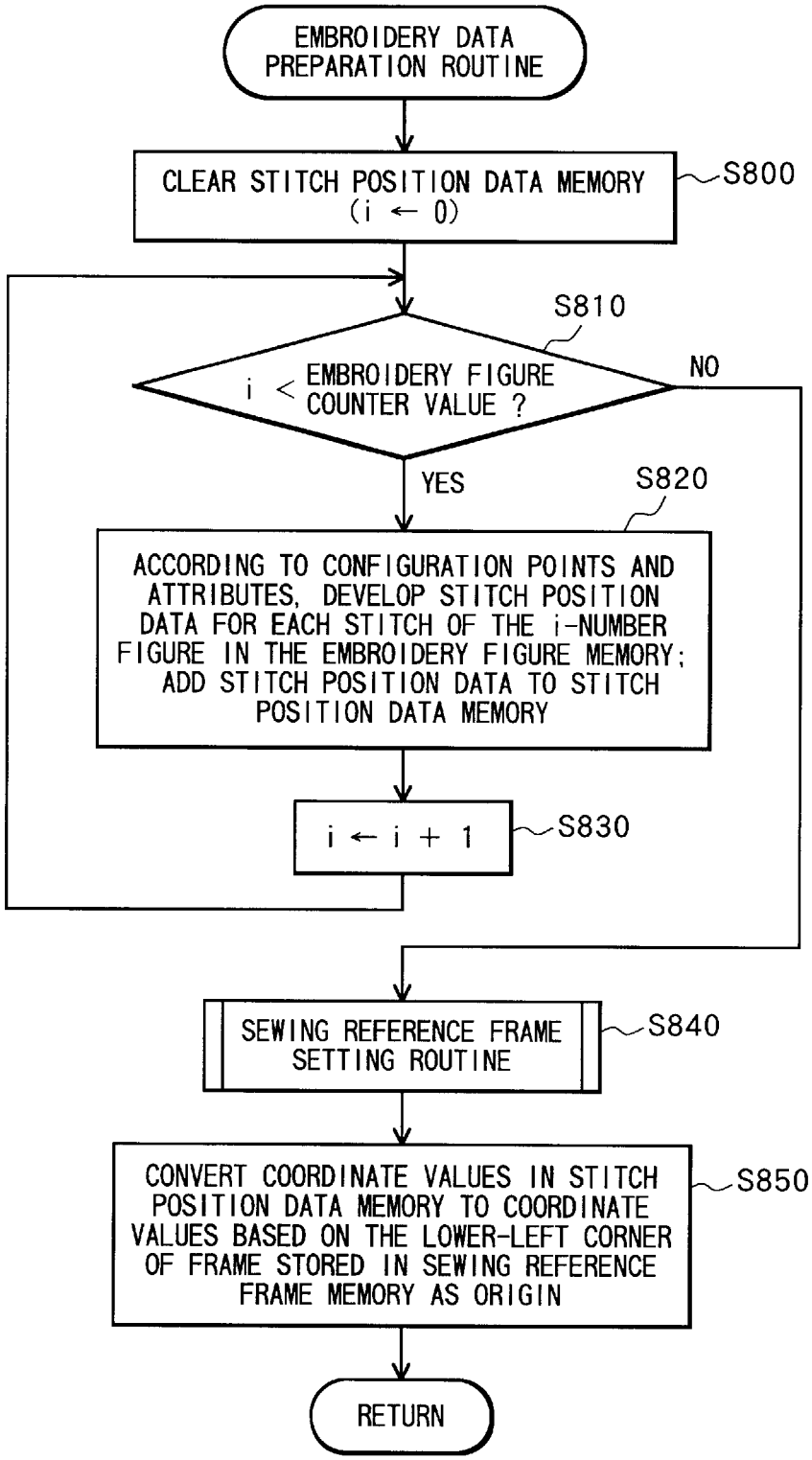
FIG. 22 is a flowchart representing an embroidery data preparation routine of the routine of FIG. 21.

When this routine is started, first the embroidery data preparation error flag 57 is cleared in S700. Then in S710 an embroidery data preparation routine represented by the routine shown in FIG. 22 is performed.

Figure 23:
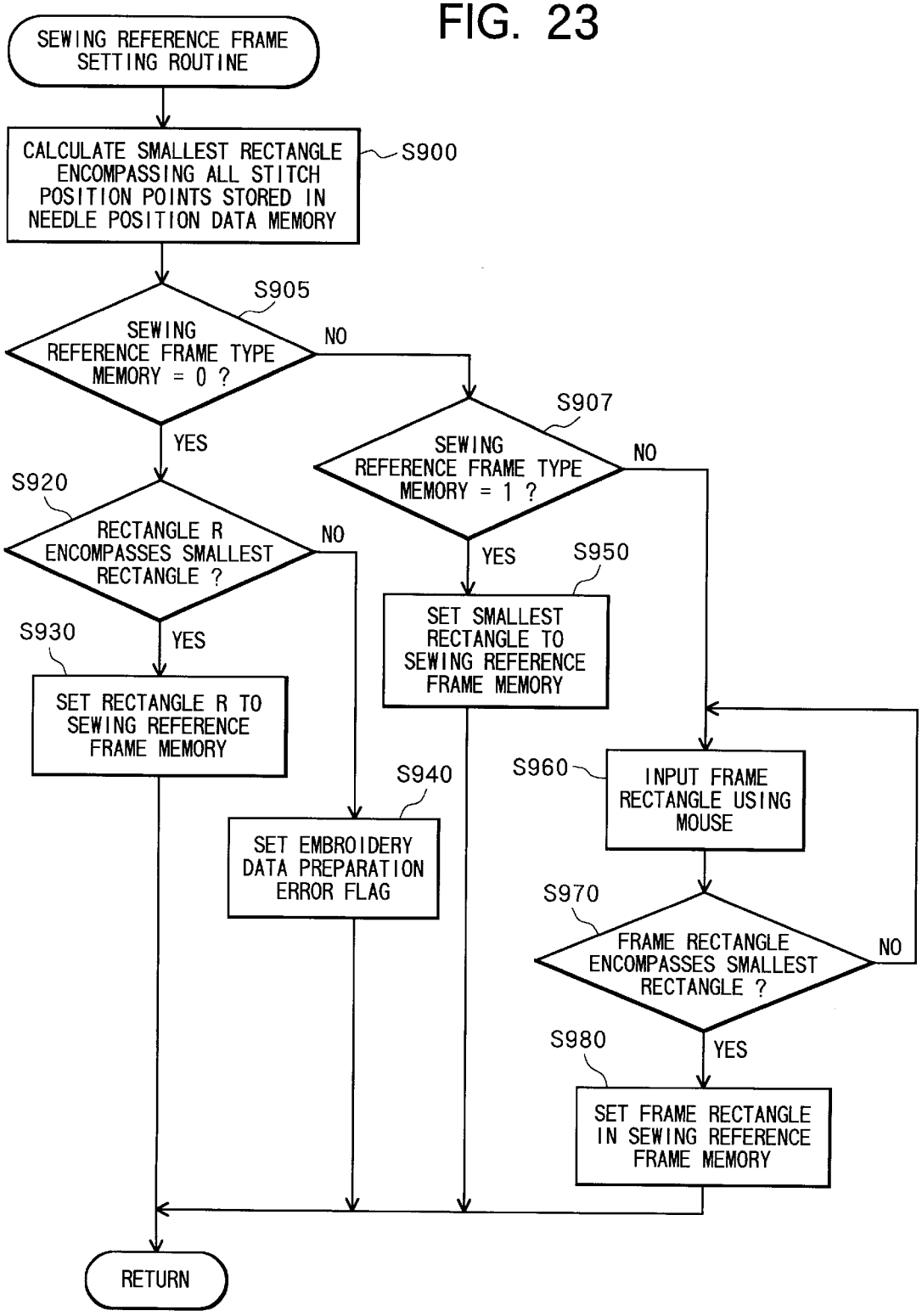
FIG. 23 is a flowchart representing a sewing reference frame routine of the embroidery data preparation routine of FIG. 22.

At the start of this routine, the needle position data memory 55 is cleared in S800. Also, an index i which specifies a particular embroidery pattern is set to 0. The value of the index i corresponds to the order in which embroidery patterns are input. Next, whether or not the index i is smaller than the value stored in the embroidery figure counter 53, which represents the total number of embroidery patterns, is determined in S810. When the index i is smaller (S810:YES), then the figure in the embroidery figure memory 54 indicated by the value of the index i is converted into stitch position data according to corresponding configuration points and sewing attributes. The processes of S820 are performed using well-known techniques for changing internal portions of an outline into stitch data for individual stitches. Such a process is described in U.S. Pat. No. 5,231,941, which is hereby incorporated by reference, In S820, the stitch data is added to the needle position data memory 55 for an embroidery pattern indicated by the value of the index i. Afterward, the index i is incremented by one in S830. The program returns to S810 in order to determined the stitch positions corresponding to the next embroidery pattern. When the value of the index i exceeds the value stored in the embroidery figure counter 53 (S810:NO), then it is determined that stitch positions for all embroidery patterns have been determined, whereupon in S840 a sewing reference frame setting routine represented by the flowchart shown in FIG. 23 is executed.

When this routine is started, the smallest rectangle that surrounds all the stitch position points stored in the needle position data memory 55 is automatically calculated in S900 and then the value of the sewing reference frame type memory 52 is automatically determined via S905 and S907. In S900, the smallest and the largest values of the X and Y coordinates of the stitch positions determined in S320 are extracted from the needle position data memory 55. Based on these coordinates, a point defined by the largest X-coordinate value and the largest Y-coordinate value and a point defined by the smallest X-coordinate value and the smallest Y-coordinate value are determined. Line segments connecting these two points are used as diagonals of the smallest rectangle so that the smallest rectangle contacts and encompasses the embroidery pattern.

When the value of the sewing reference frame type memory 52 is 0 (S905:YES), whether or not maximum rectangle R encompasses the smallest rectangle calculated in S900 is determined in S920. If so (S920:YES), then coordinate values of two points defining the maximum rectangle R are automatically set in the sewing reference frame memory 56 in S930. The two points define the maximum rectangle R by representing the diagonal vertices of the maximum rectangle R. On the display, the two points correspond to the lower-left and the upper-right vertices of the maximum rectangle R. When the maximum rectangle R does not encompass the smallest rectangle (S920:NO), then the embroidery data preparation error flag 57 is automatically set in S940. When the value in the sewing reference frame type memory 52 is 1 (S905:NO, S907:YES), then the value of the smallest rectangle calculated in S900 is set in the sewing reference frame memory 56 in S950.

When the value stored in the sewing reference frame type memory 52 is 2 (S905 and S907:NO), then the user inputs a rectangle frame using the mouse 4 or keyboard 3 in S960. Then whether or not the inputted rectangular frame encompasses the smallest rectangle calculated in S900 is determined in S970. If not (S970:NO), then the program returns to S960 so that the user can reinput another rectangular frame. If the inputted rectangular frame encompass the smallest rectangle calculated in S900 (S970:YES), then the value of the rectangular frame set by the user in S960 is set in the sewing reference frame memory 56 in S980. After the processes of the sewing reference frame setting routine are completed, the program returns to after S840 of FIG. 22.

When the routine of S840 is completed, then in S850 the coordinate values stored in the needle position data memory 55 are all converted to values based on the coordinate values representing the lower-left corner of the sewing reference frame memory 56. In this conversion process, coordinate values (a, b) representing the lower-left corner of the sewing reference frame memory 56 are subtracted from coordinate values (x, y) of the needle position data memory 55 (i.e, x−a, y−b). For example as shown in FIGS. 14 and 15, when the maximum rectangle R, which corresponds to the sewable region 38, is set as the sewing reference frame, a point A (−44, −44) of the embroidery pattern shown in FIG. 14 is converted into a point P1 (6, 6) indicated in FIG. 15. Afterward, the program returns to after S710 indicated in FIG. 19.

When the processes in S710 are completed, whether or not the embroidery data preparation error flag 57 is set is determined in S720. If so (S720:YES), this is because it was determined in S920 of FIG. 21 that the maximum rectangle R does not encompass the embroidery pattern. As a result, it is determined that the maximum rectangle R is inappropriate as the sewing reference frame. Therefore, in S750 of FIG. 19 an error message such as "CHANGE THE POSITION OR SIZE OF THE PATTERN SO THAT IT IS ENCOMPASSED BY THE MAXIMUM RECTANGLE R" is displayed.

When the embroidery data preparation error flag 57 is not set (S720:NO), then the width (W) and height (H) of the sewing reference frame memory 56 are written into the embroidery data card 7 in S730. Then the value of the needle position data memory 55 is written into the embroidery data card 7 in S740. In the example shown in FIG. 14, the coordinate values of each stitch point and a width W of 100 and a height of 100 of the sewing reference frame as indicated in FIG. 15 are written in the embroidery data card 7. After the embroidery data card writing routine of FIG. 21 is completed, then the program returns to after S665 of FIG. 20.

After the processes of S665 are completed, the menu button M1 is removed from the screen in S680 and the program returns to after S195 in FIG. 11. As a result of the above-described processes, an embroidery pattern inputted by a user is developed into embroidery data of the embroidery pattern and then the embroidery data is written on the embroidery data card 7.

When the embroidery data card 7 is inserted into the flash memory unit 11 of the embroidery sewing machine 10, the embroidery data is read out from the embroidery data card 7. Because the size of the sewing reference frame of the embroidery pattern is the same as the size of the sewable region, that is, W=100 and H=100, the embroidery pattern is positioned to a desired position in relation to the left edge of the embroidery region. Therefore, there is no need for the operator to move the layout by using the movement keys 35*a*, 35*b*, 35*c*, and 35*d*. That is, the positional relationship of the embroidery pattern to the sewable region 38 corresponds to the positional relationship of the embroidery pattern to the maximum rectangle R inputted using the sewing reference frame setting menu shown in FIG. 19.

As explained above, a maximum rectangle R with size corresponding to the size of the sewable region 38 is displayed on the CRT display 2. A user uses the keyboard 3 and the mouse 4 to input an embroidery pattern within the maximum rectangle R and to set the maximum rectangle R surrounding the inputted embroidery pattern as the sewing reference frame. Embroidery data is prepared so that the embroidery stitches of the embroidery pattern are formed with the lower-left point of the sewing reference frame as the origin. This edits the embroidery pattern so that the embroidery pattern appears in the sewable region 38 as inputted with respect to the lower-left point of the sewing reference frame. Moreover, when the embroidery pattern is to be sewn using the embroidery sewing machine 10, embroidery processes will be started from a desired position without the need for the operator to move the embroidery frame 12.

While the invention has been described in detail with reference to specific embodiments thereof, it would be apparent to those skilled in the art that various changes and modifications may be made therein without departing from the spirit of the invention, the scope of which is defined by the attached claims.

For example, in the above-described embodiment, it was described that embroidery patterns are inputted using the mouse 4. However, previously prepared embroidery patterns can be read from the external input-output device 5 or from the embroidery data card 7 instead.

Also, in the above-described embodiment, the lower-left point of the sewing reference frame was used as the origin of a coordinate system indicating stitch positions of an embroidery pattern in embroidery data. However, other points, such as one of the four corners of the sewing reference frame, a point between any two of the four corners of the sewing reference frame, or the center point of the sewing reference frame, could be used as the origin.

Also, as shown in FIGS. 8, 13(*a*), and 14, right served as the positive direction of X coordinates and up served as the positive direction of Y coordinates in the coordinate system used in the embroidery data for defining stitch positions of the embroidery pattern. However, left instead could be used as the positive direction for X coordinates. Also, down instead could be used as the positive direction for Y coordinates.

Although in the present embodiment, the values for the maximum rectangle R were stored as a portion of the program, the values for the maximum rectangle R could be stored in retrievable form in some other memory, such as the ROM 21, the RAM 30, or an external memory device. Further, although the values for one type of maximum rectangle R were stored as an embroidery sewable region, data for many other types of rectangles could be stored also. Also, although only one maximum rectangle R was stored in the present embodiment to represent the sewable region of only one type of sewing machine, many maximum rectangles could be stored in correspondence with sewable regions of many other types of sewing machines. Also, although processes to convert image data into embroidery data were performed directly before data was stored in the embroidery data card 7 of the external memory, this conversion could be performed directly after the image data is inputted.

What is claimed is:

1. A sewing data processor comprising:

input means for inputting a sewing pattern to be sewn within a sewable region of a sewing machine;

sewing data preparation means for preparing sewing data to be used in the sewing machine for sewing the sewing pattern, the sewing data preparation means including a sewing reference frame encompassing the sewing pattern, the sewing data preparation means preparing the sewing data from coordinates based on a predetermined point within said sewing reference frame;

sewing reference frame setting means for setting the sewable region of the sewing machine as the sewing reference frame; and a display for displaying the sewing pattern and the sewable region.

2. A sewing data processor as claimed in claim 1 wherein the sewing reference frame setting means is also capable of setting another region encompassing the sewing pattern as the sewing reference frame, further comprising selection means for selecting as the sewing reference frame one of the sewable region of the sewing machine and the another region.

3. A sewing data processor as claimed in claim 2 wherein the another region is a smallest sewing reference frame capable of encompassing the sewing pattern.

4. A sewing data processor as claimed in claim 2 wherein the another region is an optional sewing reference frame with size inputted via the input means.

5. A sewing data processor as claimed in claim 2 wherein the another region is at least one of a smallest sewing reference frame capable of encompassing the sewing pattern and an optional sewing reference frame with size inputted via the input means.

6. A sewing data processor as claimed in claim 5, wherein the sewing data preparation means prepares sewing data for use in a sewing machine capable of, after positioning the sewing reference frame in a predetermined initial position, changing position of the sewing pattern within the sewing reference frame.

7. A sewing data processor as claimed in claim 6 wherein the sewing data preparation means prepares sewing data for use in a sewing machine capable of changing position of the sewing pattern in relation to a border portion of the sewable region.

8. A sewing data processor as claimed in claim 6 wherein the sewing data preparation means prepares sewing data for use in a sewing machine capable of combining a plurality of sewing patterns.

9. A sewing data processor as claimed in claim 5 wherein the sewing data preparation means prepares sewing data for use in a sewing machine capable of changing position of the sewing pattern in relation to a border portion of the sewable region.

10. A sewing data processor as claimed in claim 9 wherein the sewing data preparation means prepares sewing data for use in a sewing machine capable of combining a plurality of sewing patterns.

11. A sewing data processor as claimed in claim 5 wherein the sewing data preparation means prepares sewing data for use in a sewing machine capable of combining a plurality of sewing patterns.

12. A sewing data processor as claimed in claim 1 wherein the sewing data preparation means prepares sewing data for use in a sewing machine capable of combining a plurality of sewing patterns.

13. A sewing data processor as claimed in claim 1, wherein the display additionally displays a gauge for assisting in positioning of the sewing pattern in the sewable region.

* * * * *